US012173972B2

(12) United States Patent
Li et al.

(10) Patent No.: US 12,173,972 B2
(45) Date of Patent: Dec. 24, 2024

(54) MULTI-COIL MICROCHANNEL HEAT EXCHANGERS AND AIR CONDITIONING UNITS

(71) Applicant: Trane Air Conditioning Systems (China) CO., LTD., Jiangsu (CN)

(72) Inventors: Lifen Li, Jiangsu (CN); Wei Luo, Jiangsu (CN); Yedan Wu, Jiangsu (CN)

(73) Assignee: Trane Air Conditioning Systems (China) CO., LTD., Jiangsu (CN)

( * ) Notice: Subject to any disclaimer, the term of this patent is extended or adjusted under 35 U.S.C. 154(b) by 234 days.

(21) Appl. No.: 18/013,733

(22) PCT Filed: Sep. 27, 2022

(86) PCT No.: PCT/CN2022/121566
§ 371 (c)(1),
(2) Date: Dec. 29, 2022

(87) PCT Pub. No.: WO2022/247971
PCT Pub. Date: Dec. 1, 2022

(65) Prior Publication Data

US 2024/0102748 A1 Mar. 28, 2024

(30) Foreign Application Priority Data

Sep. 23, 2022 (CN) ..... 202211168210.2

(51) Int. Cl.
*F28F 9/26* (2006.01)
*F28D 7/04* (2006.01)
*F28F 9/02* (2006.01)

(52) U.S. Cl.
CPC ..... *F28F 9/26* (2013.01); *F28D 7/04* (2013.01); *F28F 9/02* (2013.01)

(58) Field of Classification Search
CPC .... F28D 1/0443; F28D 1/0452; F28D 1/0426; F28D 1/05308; F28D 1/05391;
(Continued)

(56) References Cited

U.S. PATENT DOCUMENTS 10,612,856 B2 4/2020 Junfeng et al.
2010/0006276 A1* 1/2010 Cremaschi ..... B21D 53/085 165/173

(Continued)

FOREIGN PATENT DOCUMENTS

CA 2983728 A1 * 4/2018 ..... F25B 39/00
CN 101978237 A 2/2011

(Continued)

OTHER PUBLICATIONS

ISA State Intellectual Property Office of the People's Republic of China, International Search Report Issued in Application No. PCT/CN2022/121566, Jun. 17, 2023, WIPO, 6 pages. (Submitted with Machine Translation).

(Continued)

*Primary Examiner* — Tho V Duong
(74) *Attorney, Agent, or Firm* — Greenblum & Bernstein, P.L.C.

(57) ABSTRACT

A multi-coil microchannel heat exchanger includes a first coil including a first inlet header, a first outlet header and first microchannel tubes; a second coil including a second inlet header, a second outlet header and second microchannel tubes; a first inlet connector fluidly connected to the first inlet header; a first outlet connector fluidly connected to the first outlet header; a second inlet connector fluidly connected to the second inlet header; and a second outlet connector fluidly connected to the second outlet header. The first coil and the second coil are arranged successively along the length direction of the multi-coil microchannel heat (Continued)

exchanger. The multi-coil microchannel heat exchanger includes a first side and a second side along the length direction, the first inlet connector, the first outlet connector, the second inlet connector and the second outlet connector are all located at the first side.

17 Claims, 20 Drawing Sheets

(58) Field of Classification Search
CPC ..... F28D 7/04; F28D 15/0233; F28F 9/02; F28F 9/26; F25B 39/04
See application file for complete search history.

(56) References Cited

U.S. PATENT DOCUMENTS

| | | | | |
|---|---|---|---|---|
| 2018/0058763 | A1* | 3/2018 | Wei | F28D 7/1638 |
| 2021/0215431 | A1 | 7/2021 | Aringdom et al. | |
| 2021/0341189 | A1 | 11/2021 | Peppard et al. | |
| 2022/0018553 | A1 | 1/2022 | Ryota et al. | |

FOREIGN PATENT DOCUMENTS

| | | | | | |
|---|---|---|---|---|---|
| CN | 104596153 | A | * | 5/2015 | F25B 39/00 |
| CN | 205919730 | U | | 2/2017 | |
| CN | 206459329 | U | | 9/2017 | |
| CN | 107702382 | A | | 2/2018 | |
| CN | 207975825 | U | | 10/2018 | |
| CN | 113108455 | A | | 7/2021 | |
| CN | 215412617 | U | | 1/2022 | |
| JP | 2018100803 | A | | 6/2018 | |
| WO | WO-2008064263 | A2 | * | 5/2008 | F25B 39/028 |
| WO | WO-2011005986 | A2 | * | 1/2011 | F24F 1/18 |
| WO | 2012002698 | A2 | | 1/2012 | |
| WO | WO-2017161939 | A1 | * | 9/2017 | F25B 39/02 |
| WO | WO-2020129496 | A1 | * | 6/2020 | |
| WO | WO2021/014522 | A1 | | 1/2021 | |
| WO | 2021082618 | A1 | | 5/2021 | |

OTHER PUBLICATIONS

ISA State Intellectual Property Office of the People's Republic of China, Written Opinion of the International Searching Authority Issued in Application No. PCT/CN2022/121566, Jun. 17, 2023, WIPO, 6 pages. (Submitted with Machine Translation).
Extended European Search Report in counterpart Application No. EP22810694, dated Aug. 6, 2024.

* cited by examiner

MULTI-COIL MICROCHANNEL HEAT EXCHANGERS AND AIR CONDITIONING UNITS

CROSS REFERENCE TO RELATED APPLICATIONS

This application is a US National Phase of a PCT Application No. PCT/CN2022/121566 filed on Sep. 27, 2022, which claims priority to Chinese Patent Application No. 2022111682102 filed on Sep. 23, 2022, the entire contents of which are incorporated herein by reference in their entireties.

TECHNICAL FIELD

The present disclosure relates to the technical field of heat exchangers, and in particular, to a multi-coil microchannel heat exchangers and air conditioning units.

BACKGROUND

A Microchannel Heat Exchanger (MCHE) typically includes an inlet header, an outlet header, and a plurality of flat tubes connected to and in communication with these headers. Each flat tube has microchannels or small paths for refrigerant (gas or liquid) to pass through. During operation, in a microchannel heat exchanger, the refrigerant enters the inlet header through the inlet of the inlet header, and then the refrigerant enters the flat tubes with microchannels, and as the refrigerant flows inside the flat tubes, the refrigerant exchanges heat with the fluid (e.g., air) outside the flat tubes. After heat exchange with the external fluid, the refrigerant leaves the flat tubes, enters the outlet header, and exits the outlet header through the outlet of the outlet header.

Generally, evaporators or condensers of such microchannel heat exchangers are used in air conditioning units. However, in larger tonnage air conditioning units, if the microchannel heat exchanger is made into a single coil, the length of the coil would be very long. First, the length of the coil will be limited by manufacturing production, and the manufacturing furnace of the supplier providing the coil is usually not large enough; and second, the long coil will make the length of the distribution tube of the inlet header correspondingly long, making the distribution very difficult. Therefore, in the design, the microchannel heat exchanger is usually configured in the form of two or more coils, so as to meet the user's demand for capacity.

U.S. Patent Application US2021/03411889A1 filed by Trane International Inc. on Apr. 30, 2020 discloses a multi-slab microchannel heat exchanger. The multi-slab microchannel heat exchanger includes a first slab located at a near side, a second slab located at a far side, a first inlet connector, a first outlet connector, a second inlet connector, and a second outlet connector. The first slab includes a first inlet header, a first outlet header, and a plurality of first tubes connecting the first inlet header and the first outlet header. The second slab includes a second inlet header, a second outlet header, and a plurality of second tubes connecting the second inlet header and the second outlet header. The first inlet connector is fluidly connected to the first inlet header, the first outlet connector is fluidly connected to the first outlet header, the second inlet connector is fluidly connected to the second inlet header, and the second outlet connector is fluidly connected to second outlet header. The first slab and the second slab are sequentially arranged along the length direction of the multi-slab microchannel heat exchanger. The multi-slab microchannel heat exchanger has a first side and a second side along the length direction, and the first inlet connector, the first outlet connector, the second inlet connector and the second outlet connector are arranged on the first side. The first slab has a first windward surface, and the second slab has a second windward surface. However, since the first windward surface of the first slab and the second windward surface of the second slab are in a same plane, the second inlet connector and the second outlet connector of the second slab at the far side must be arranged through the bottom of the first slab at the near side, and the second inlet connector and second outlet connector will occupy a portion of the area of the first slab at the near side. Therefore, when the area of the entire multi-slab microchannel heat exchanger is constant, a windward area of the first slab on the near side will inevitably be smaller than a windward area of the second slab on the far side.

SUMMARY

Embodiments of the present disclosure provide multi-coil microchannel heat exchangers and air conditioning units.

One aspect of the embodiments of the present disclosure provides a multi-coil microchannel heat exchanger. The multi-coil microchannel heat exchanger includes a first coil, a second coil, a first inlet connector, a first outlet connector, a second inlet connector and a second outlet connector. The first coil includes a first inlet header, a first outlet header, and first microchannel tubes, wherein the first inlet header and the first outlet header both extend along a length direction of the multi-coil microchannel heat exchanger, each of the first microchannel tubes includes an inlet and an outlet, the first inlet header is in fluid communication with the inlets of the first microchannel tubes, and the first outlet header is in fluid communication with the outlets of the first microchannel tubes. The second coil includes a second inlet header, a second outlet header, and second microchannel tubes, wherein the second inlet header and the second outlet header both extend along the length direction of the multi-coil microchannel heat exchanger, each of the second microchannel tubes includes an inlet and an outlet, the second inlet header is in fluid communication with the inlets of the second microchannel tubes, and the second outlet header is in fluid communication with the outlets of the second microchannel tubes. The first inlet connector is fluidly connected to the first inlet header. The first outlet connector is fluidly connected to the first outlet header. The second inlet connector is fluidly connected to the second inlet header. The second outlet connector is fluidly connected to the second outlet header. Wherein the first coil and the second coil are arranged successively along the length direction of the multi-coil microchannel heat exchanger. The multi-coil microchannel heat exchanger includes a first side and a second side along the length direction, the first inlet connector, the first outlet connector, the second inlet connector and the second outlet connector are all located at the first side, and the first coil includes a first windward surface, the second coil includes a second windward surface, and the first windward surface and the second windward surface are respectively located on different planes.

Another aspect of the embodiments of the present disclosure provides an air conditioning unit. The air conditioning unit includes a multi-coil microchannel heat exchanger as described above.

The multi-coil microchannel heat exchanger and the air conditioning unit of the embodiments of the present disclosure can increase the windward area of the coil, and can shorten the length of the inlet and outlet pipes at the far side.

BRIEF DESCRIPTION OF THE DRAWINGS

Accompanying drawings, which are incorporated in and constitute a part of this specification, illustrate embodiments consistent with the present disclosure and together with the description serve to explain the principles of the present disclosure.

DETAILED DESCRIPTION OF THE EMBODIMENTS

Exemplary embodiments will be described in detail herein, examples of which are illustrated in the accompanying drawings. Where the following description refers to the drawings, the same numerals in different drawings refer to the same or similar elements unless otherwise indicated. The embodiments described in the following exemplary embodiments are not intended to represent all embodiments consistent with the present disclosure. Rather, they are merely examples of means consistent with some aspects of the present disclosure as recited in the appended claims.

Terms used in the embodiments of the present disclosure are only for the purpose of describing specific embodiments, and are not intended to limit the present disclosure. Unless otherwise defined, the technical terms or scientific terms used in the embodiments of the present disclosure shall have the usual meanings understood by those with ordinary skill in the art to which the present disclosure belongs. "First", "second" and similar words used in the description and claims of the present disclosure do not denote any order, quantity or importance, but are only used to distinguish different components. Likewise, "a/an" or "one" and the like do not denote a quantitative limitation, but rather denote the presence of at least one. "A plurality of" or "several" means two or more. Unless otherwise indicated, words like "front", "rear", "left", "right", "far", "near", "top", and/or "bottom" are for convenience of description and are not limited to one position or a spatial orientation. Words like "include" or "comprise" mean that an element or item appearing before "include" or "comprise" covers elements or items listed after "include" or "comprise" and their equivalents, and other elements or objects are not excluded. "Connect" or "couple" and similar words are not limited to physical or mechanical connections, but may include electrical connections, whether direct or indirect. As used in this specification and the appended claims, the singular forms "a", "said", and "the" are intended to include plural forms as well, unless the context clearly dictates otherwise. It will also be understood that the term "and/or" as used herein refers to and includes any and all possible combinations of one or more of the associated listed items.

The present disclosure provides various embodiments of multi-coil microchannel heat exchangers. The composition of the multi-coil microchannel heat exchanger of each embodiment of the present disclosure will be described in detail below with reference to the accompanying drawings. Multi-coil microchannel heat exchangers of the present disclosure are not limited to the structural forms described in the following embodiments. Without departing from the essence of the present application, the multi-coil microchannel heat exchangers of the present disclosure may further include some other structural transformation forms.

First Embodiment

Figure 1:
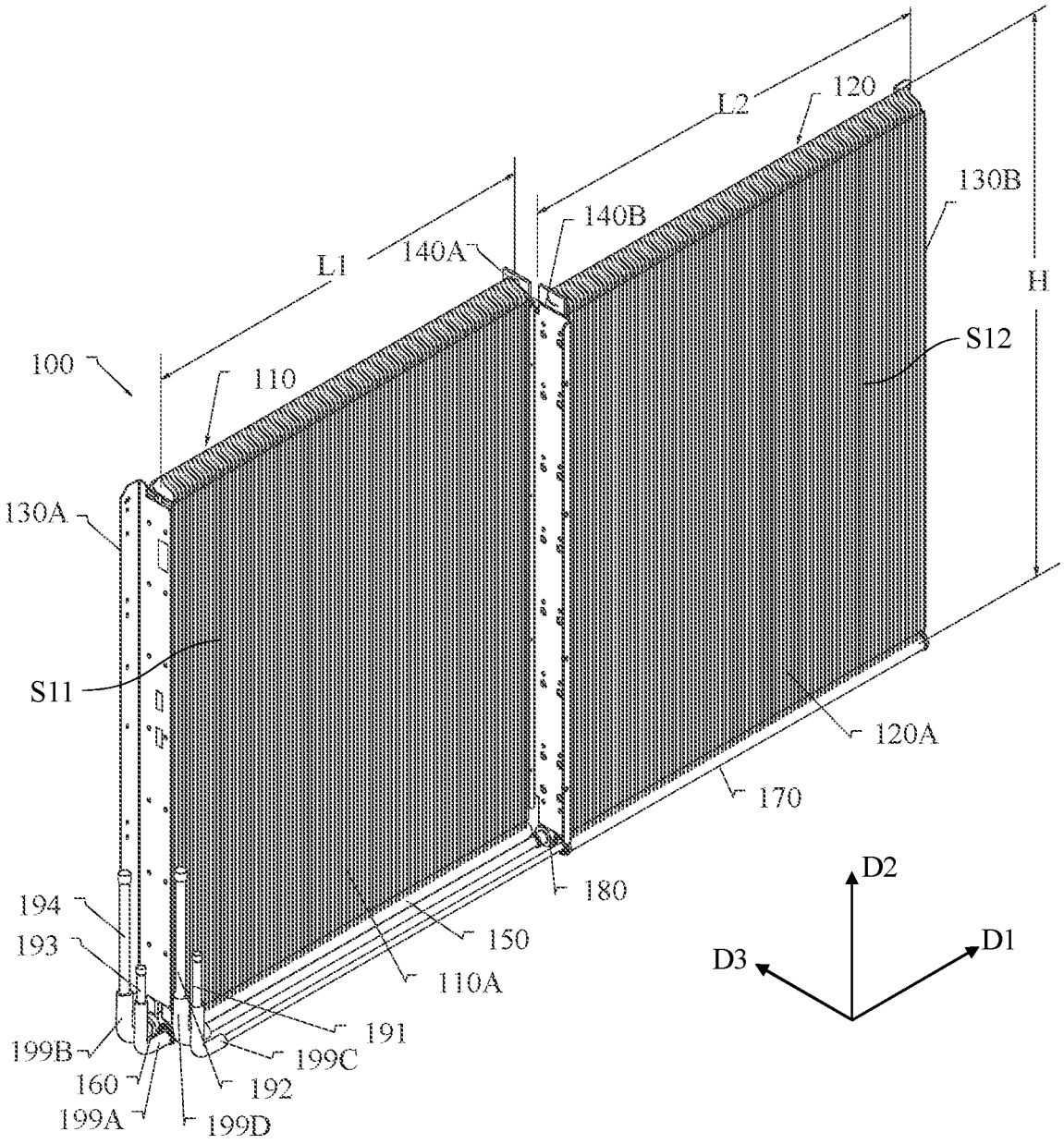
FIG. 1 is a perspective view of a multi-coil microchannel heat exchanger according to a first embodiment of the present disclosure.
Figure 2:
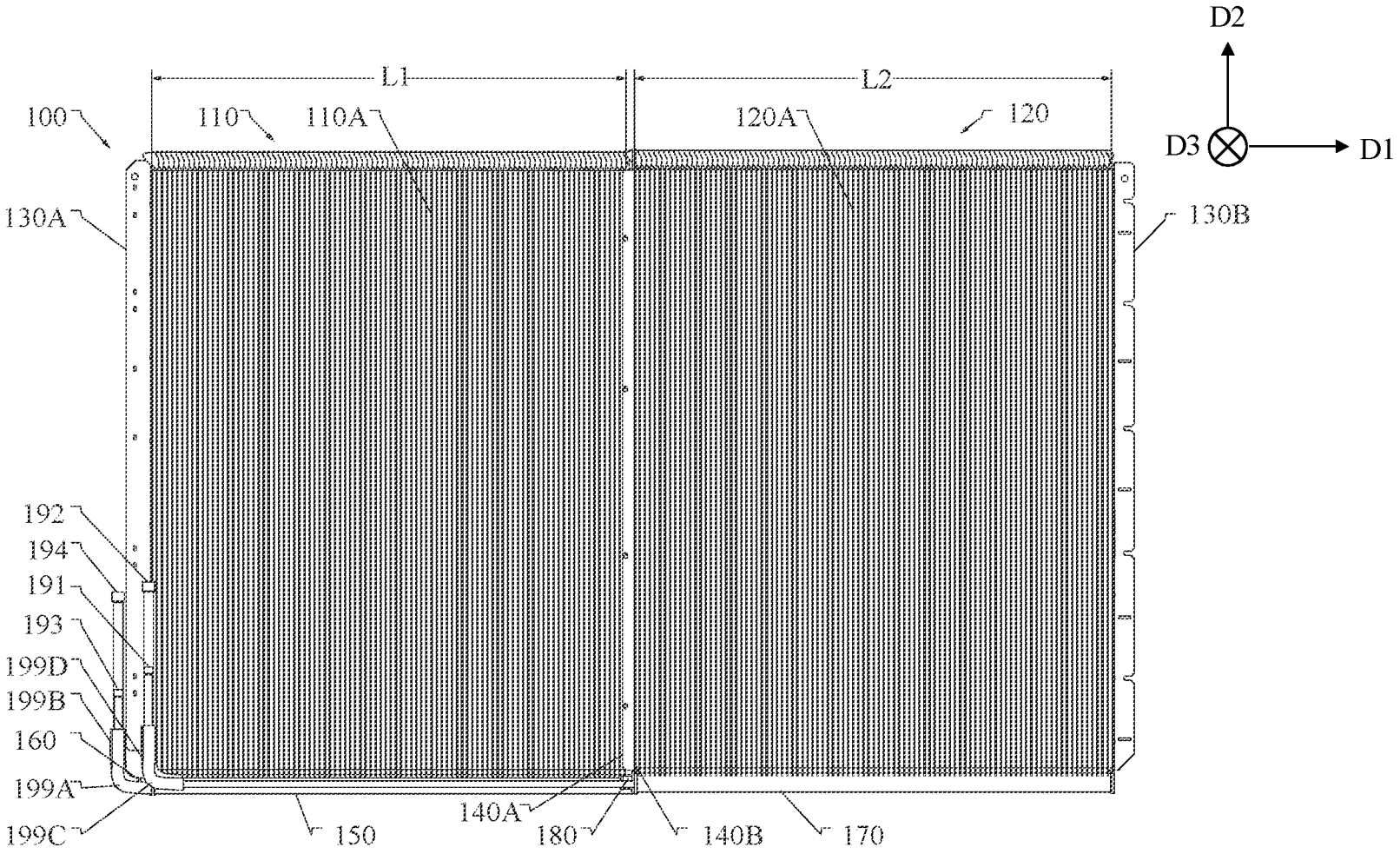
FIG. 2 is a front view of the multi-coil microchannel heat exchanger according to the first embodiment of the present disclosure.
Figure 3:
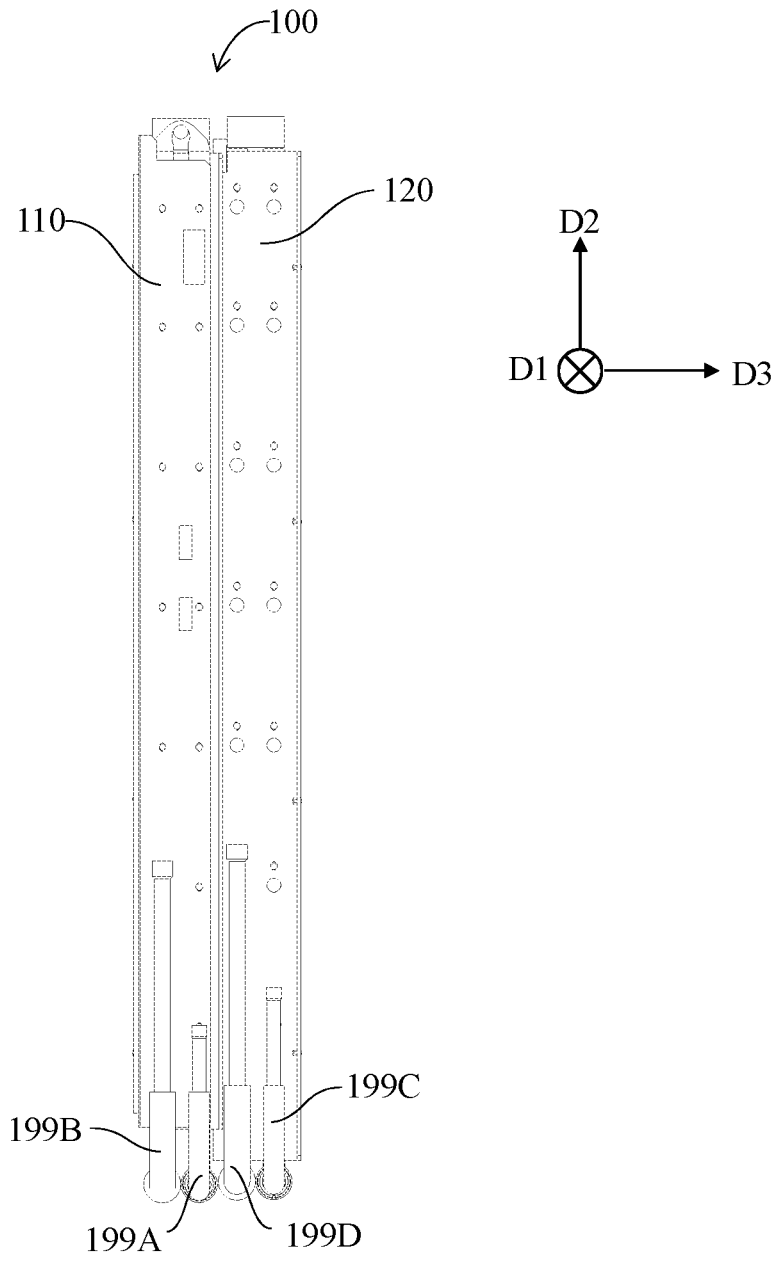
FIG. 3 is a left side view of the multi-coil microchannel heat exchanger according to the first embodiment of the present disclosure.

FIGS. 1 to 3 illustrate diagrams of a multi-coil microchannel heat exchanger 100 according to a first embodiment of the present disclosure, where FIG. 1 illustrates a perspective view of the multi-coil microchannel heat exchanger 100; FIG. 2 illustrates a front view of the multi-coil microchannel heat exchanger 100; and FIG. 3 illustrates a left side view of the multi-coil microchannel heat exchanger 100.

For the multi-coil microchannel heat exchanger 100, a length direction D1, a height direction D2 perpendicular to the length direction D1, and a thickness direction D3 perpendicular to the length direction D1 and the height direction D2 are defined to describe the relative positional relationship of each component in the multi-coil microchannel heat exchanger 100 below.

As shown in FIGS. 1-3, the multi-coil microchannel heat exchanger 100 includes a first coil 110 located at a near side and a second coil 120 located at a far side. The near side refers to a side where maintenance or servicing procedures can be easily performed on the multi-coil microchannel heat exchanger 100. For example, for FIGS. 1 and 2, the near side may correspond to the left side of the paper, and the far side may correspond to the right side of the paper.

The first coil 110 includes a first inlet header 150, a first outlet header 160, and a plurality of first microchannel tubes 110A. The first inlet header 150 and the first outlet header 160 each have a length L1, and the first inlet header 150 and the first outlet header 160 both extend along the length direction D1 of the multi-coil microchannel heat exchanger 100. The plurality of first microchannel tubes 110A are sequentially arranged along the length direction of the first coil 110 (i.e., the length direction D1 of the multi-coil microchannel heat exchanger 100). Each of the first microchannel tubes 110A may be a flat multiport tube extending in the height direction of the first coil 110 (i.e., the height direction D2 of the multi-coil microchannel heat exchanger 100 in this embodiment). In an embodiment, two adjacent first microchannel tubes 110A generally further have fins (not shown) brazed therebetween. Each of the first microchannel tubes 110A includes an inlet and an outlet, the inlets of the plurality of first microchannel tubes 110A are in fluid communication with the first inlet header 150, and the outlets of the plurality of first microchannel tubes 110A are in fluid communication with the first outlet header 160.

The first coil 110 further includes a first bracket 140A. In an embodiment, the first bracket 140A may be a flat slab made of aluminum or an aluminum alloy extending from the top to the bottom of the first coil 110 in the height direction D2 of the first coil 110. The first bracket 140A is fixed to the last first microchannel tube 110A of the first coil 110 (i.e., the first microchannel tube 110A located at the rightmost end of the first coil 110 in the length direction D1 of the first coil 110). The first coil 110 further includes a first end support 130A. The first end support 130A may be a flat slab extending from the top to the bottom of the first coil 110 in the height direction D2 of the first coil 110. The first end support 130A is fixed to the first first microchannel tube 110A of the first coil 110 (i.e., the first microchannel tube 110A located at the leftmost end of the first coil 110 in the length direction D1 of the first coil 110).

The second coil 120 includes a second inlet header 170, a second outlet header 180, and a plurality of second microchannel tubes 120A. The second inlet header 170 and the second outlet header 180 each have a length L2, and both the second inlet header 170 and the second outlet header 180 extend along the length direction D1 of the multi-coil microchannel heat exchanger 100. The plurality of second microchannel tubes 120A are sequentially arranged along the length direction D1 of the second coil 120 (i.e., the length direction D1 of the multi-coil microchannel heat exchanger 100). Each of the second microchannel tubes 120A may be a flat multiport tube extending in the height direction D2 of the second coil 120. In an embodiment, two adjacent second microchannel tubes 120A generally further have fins (not shown) brazed therebetween. Each second microchannel tube 120A includes an inlet and an outlet, the second inlet header 170 is in fluid communication with the inlets of the plurality of second microchannel tubes 120A, and the second outlet header 180 is in fluid communication with the outlets of the plurality of second microchannel tubes 120A.

The second coil 120 further includes a second bracket 140B. In an embodiment, the second bracket 140B may be a flat slab made of aluminum or an aluminum alloy extending from the top to the bottom of the second coil 120 in the height direction D2 of the second coil 120. The second bracket 140B is fixed to the first second microchannel tube 120A of the second coil 120 (i.e., the second microchannel tube 120A located at the leftmost end of the second coil 120 in the length direction D1 of the second coil 120). The second coil 120 further includes a second end support 130B. The second end support 130B may be a flat slab extending from the top to the bottom of the second coil 120 in the height direction of the second coil 120 (in this embodiment, that is, the height direction D2 of the multi-coil microchannel heat exchanger 100). The second end support 130B is fixed to the last second microchannel tube 120A of the second coil 120 (i.e., the second microchannel tube 120A located at the rightmost end of the second coil 120 in the length direction D1 of the second coil 120).

The first coil 110 and the second coil 120 are essentially sequentially arranged along the length direction D1 of the multi-coil microchannel heat exchanger 100. By the fitting installation between the first bracket 140A of the first coil 110 and the second bracket 140B of the second coil 120, the first coil 110 and the second coil 120 can be connected together.

The multi-coil microchannel heat exchanger 100 further includes a first inlet connector 199A, a first outlet connector 199B, a second inlet connector 199C and a second outlet connector 199D. The first inlet connector 199A is fluidly connected to the first inlet header 150 and the first outlet connector 199B is fluidly connected to the first outlet header 160. The second inlet connector 199C is fluidly connected to the second inlet header 170 and the second outlet connector 199D is fluidly connected to the second outlet header 180.

The multi-coil microchannel heat exchanger 100 further includes a first inlet conduit 193, a first outlet conduit 194, a second inlet conduit 191 and a second outlet conduit 192. The first inlet conduit 193 is connected to the first inlet header 150 through the first inlet connector 199A, and the first outlet conduit 194 is connected to the first outlet header 160 through the first outlet connector 199B. The second inlet conduit 191 is connected to the second inlet header 170 through the second inlet connector 199C, and the second outlet conduit 192 is connected to the second outlet header 180 through the second outlet connector 199D.

The multi-coil microchannel heat exchanger 100 has a first side and a second side along the length direction D1. The first inlet connector 199A, the first outlet connector 199B, the second inlet connector 199C, and the second outlet connector 199D are all located at the first side of the multi-coil microchannel heat exchanger 100 (i.e., the left side of the paper shown in FIG. 1). By arranging the first inlet connector 199A, the first outlet connector 199B, the second inlet connector 199C and the second outlet connector 199D at the same side of the multi-coil microchannel heat exchanger 100 along the length direction D1, the inlets and the outlets are at the same side, such that the total length of the inlet and outlet pipes used by the multi-coil microchannel heat exchanger 100 can be relatively reduced.

As shown in FIG. 1 and FIG. 2, the first coil 110 includes a first windward surface S11, the length of the first coil 110 is L1, the height of the first coil 110 is H, and the area of the first windward surface S11=L1×H. The second coil 120 includes a second windward surface S12, the length of the second coil 120 is L2, the height of the second coil 120 is H, and the area of the second windward surface S12=L2×H.

As shown in FIG. 1, the first windward surface S11 of the first coil 110 and the second windward surface S12 of the second coil 120 are respectively located on different planes. In this embodiment, as shown in FIG. 3, viewed along the length direction D1 of the multi-coil microchannel heat exchanger 100, the first windward surface S11 of the first coil 110 and the second windward surface S12 of the second coil 120 are parallel to each other, and the first windward surface S11 and the second windward surface S12 are parallel to the height direction D2 of the multi-coil microchannel heat exchanger 100.

The multi-coil microchannel heat exchanger 100 shown in FIGS. 1-3 is a two-pass heat exchanger. The first inlet header 150, the first inlet connector 199A, the second inlet header 170, the second inlet connector 199C, the first outlet header 160, the first outlet connector 199B, the second outlet header 180 and the second outlet connector 199D are all located at the bottom of the multi-coil microchannel heat exchanger 100.

The first inlet header 150 and the first outlet header 160 are located at the bottom of the first coil 110, and the second inlet header 170 and the second outlet header 180 are located at the bottom of the second coil 120. Since the first windward surface S11 of the first coil 110 and the second windward surface S12 of the second coil 120 are located on different planes and are parallel to each other, the first coil 110 and the second coil 120 may be sequentially arranged along the thickness direction D3 of the microchannel heat exchangers 100. Therefore, the second inlet connector 199C and the first inlet header 150 can be arranged along the thickness direction D3 of the multi-coil microchannel heat exchanger 100, and the second outlet connector 199D and the first outlet header 160 may be arranged along the thickness direction D3 of the multi-coil microchannel heat exchanger 100. The second inlet connector 199C and the second outlet connector 199D located at a far side can extend through a side of the first coil 110 located at a near side in the thickness direction D3 of the multi-coil microchannel heat exchanger 100, without extending through the bottom of the first coil 110 located at the near side. Therefore, the height of the first coil 110 located in the near side does not need to be reduced, and the second inlet connector 199C and the second outlet connector 199D located at the far side do not occupy the windward area of the first coil 110 located at the near side. As shown in FIGS. 1 and 2, the first inlet header 150 and the first outlet header 160 of the first coil 110, and the second inlet connector 199C and the second outlet connector 199D may be respectively arranged along the thickness direction D3 of the multi-coil microchannel heat exchanger 100.

In some embodiments, the first coil 110 and the second coil 120 may be the same. The first coil 110 and the second coil 120 have the same length, i.e., L1=L2, therefore, the first windward surface S11 of the first coil 110 and the second windward surface S12 of the second coil 120 may have the same windward area. Since the multi-coil microchannel heat exchanger 100 of the present disclosure can be formed by using same coils, the structure and manufacturing process of the multi-coil microchannel heat exchanger 100 can be simplified, and the cost can be reduced.

When the multi-coil microchannel heat exchanger 100 operates, the refrigerant first flows from the first inlet conduit 193 and the second inlet conduit 194 of the multi-coil microchannel heat exchanger 100, and through the first inlet connector 199A and the second inlet connector 199C, respectively flows into the first inlet header 150 and the second inlet header 170, and then the refrigerant respectively enters the first microchannel tubes 110A of the first coil 110 and the second microchannel tubes 120A of the second coil 120. The refrigerant flows from the bottom of the multi-coil microchannel heat exchanger, respectively through the first microchannel tubes 110A of the first coil 110 and the second microchannel tubes 120A of the second coil 120, and to the top of the multi-coil microchannel heat exchanger, and then, flows from the top of the multi-coil microchannel heat exchanger down to the bottom of the multi-coil microchannel heat exchanger in the height direction D2. When the refrigerant flows within the first microchannel tubes 110A and the second microchannel tubes 120A, the refrigerant respectively exchanges heat with fluid (e.g., air) outside the first microchannel tubes 110A and the second microchannel tubes 120A. After heat exchange with the external fluid, the refrigerant respectively leaves the first microchannel tubes 110A and the second microchannel tubes 120A, and then respectively flows into the first outlet header 160 and the second outlet header 180, and finally, flows, through the first outlet connector 199B and the second outlet connector 199D, into the first outlet conduit 194 and the second outlet conduit 192. Thus, the process of heat exchange is completed.

The multi-coil microchannel heat exchanger 100 above is described by arranging the inlet and outlet pipes at the bottom as an example. In some other embodiments, the multi-coil microchannel heat exchanger 100 can also be provided with the inlet and outlet pipes at the top, which does not change the essence of the present disclosure, and these equivalent or minor changes are intended to fall within the scope of protection of the appended claims of the present disclosure.

The multi-coil microchannel heat exchanger 100 of the first embodiment, on the basis of shortening the length of the inlet and outlet pipes located at the far side, can make full use of the cross-sectional area of the air conditioning unit and increase the windward areas of the coils.

The above description is schematically illustrated by taking the multi-coil microchannel heat exchanger 100 as a two-pass heat exchanger as an example. However, the multi-coil microchannel heat exchanger 100 of the first embodiment of the present disclosure is not limited to a two-pass heat exchanger. In other embodiments, the multi-coil microchannel heat exchanger 100 of the first embodiment of the present disclosure may also be a single pass heat exchanger.

Figure 4:
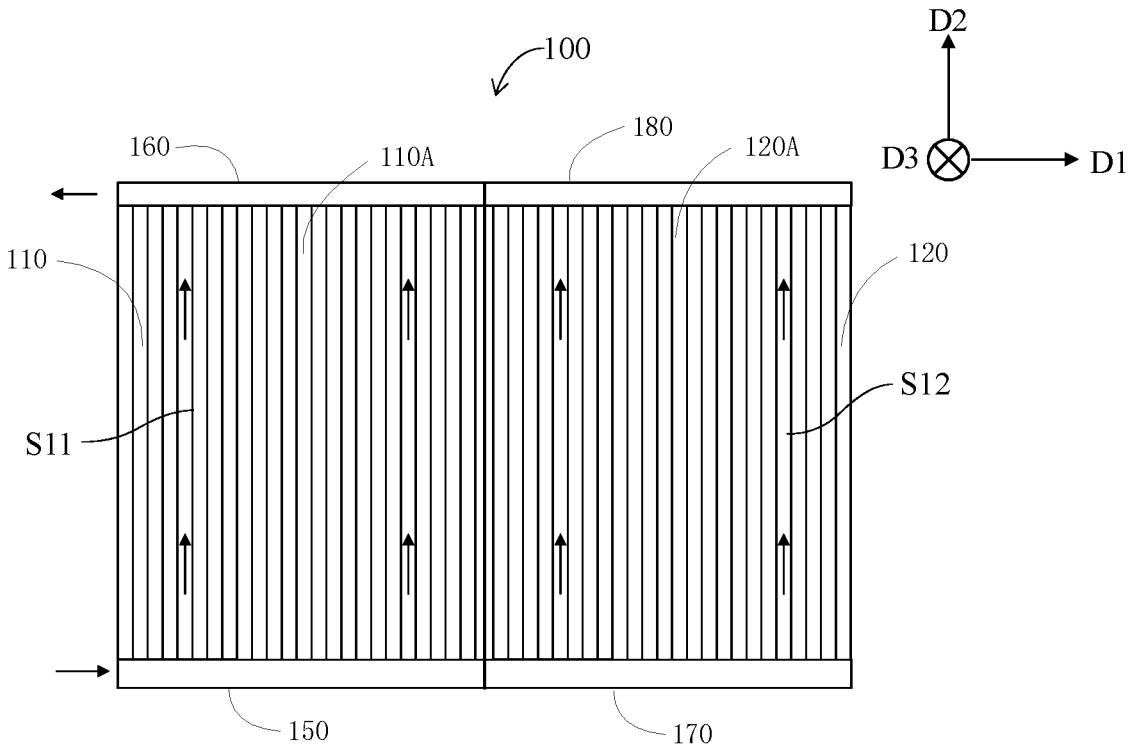
FIGS. 4 to 6 are schematic structural diagrams of other modified examples of multi-coil microchannel heat exchangers according to the first embodiment of the present disclosure.

FIG. 4 illustrates a schematic structural diagram of a single pass heat exchanger, and only the headers and microchannel tubes of the first coil 110 and the second coil 120 are shown in FIG. 4. As shown in FIG. 4, arrows indicate the flow direction of the refrigerant. It will be understood that the single pass heat exchanger shown in FIG. 4 may have the same/similar components as the two-pass heat exchanger shown in FIGS. 1-3. The difference from the two-pass heat exchanger shown in FIGS. 1 to 3 is that for the single pass heat exchanger shown in FIG. 4, the first inlet header 150, the first inlet connector, and the second inlet header 170 and the second inlet connector is located at the bottom of the multi-coil microchannel heat exchanger 100, while the first outlet header 160, the first outlet connector, the second outlet header 180 and the second outlet connector are located at the top of the multi-coil microchannel heat exchanger 100, and vice versa.

The first inlet header 150 is located at the bottom of the first coil 110, the second inlet header 170 is located at the bottom of the second coil 120; the first outlet header 160 is located at the top of the first coil 110, and the second outlet header 180 is located on the top of the second coil 120. The second inlet connector located at the far side and the first inlet header 150 of the first coil 110 located at the near side can be arranged at the bottom of the multi-coil microchannel heat exchanger 100 and along the thickness direction D3 of the multi-coil microchannel heat exchanger 100; and the second outlet connector located at the far side and the first outlet header 160 of the first coil 110 located at the near side can be arranged at the top of the multi-coil microchannel heat exchanger 100 and along the thickness direction D3 of the multi-coil microchannel heat exchanger 100.

Therefore, the second inlet connector and the second outlet connector located at the far side do not need to occupy the windward area of the first coil 110 located at the near side, and in this way, the first coil 110 located at the near side may have the same large windward area as the second coil 120 located at the far side.

The above description is schematically illustrated by taking the example that the multi-coil microchannel heat exchanger 100 includes two coils. However, the multi-coil microchannel heat exchanger 100 of the present disclosure is not limited to including two coils.

Figure 5:
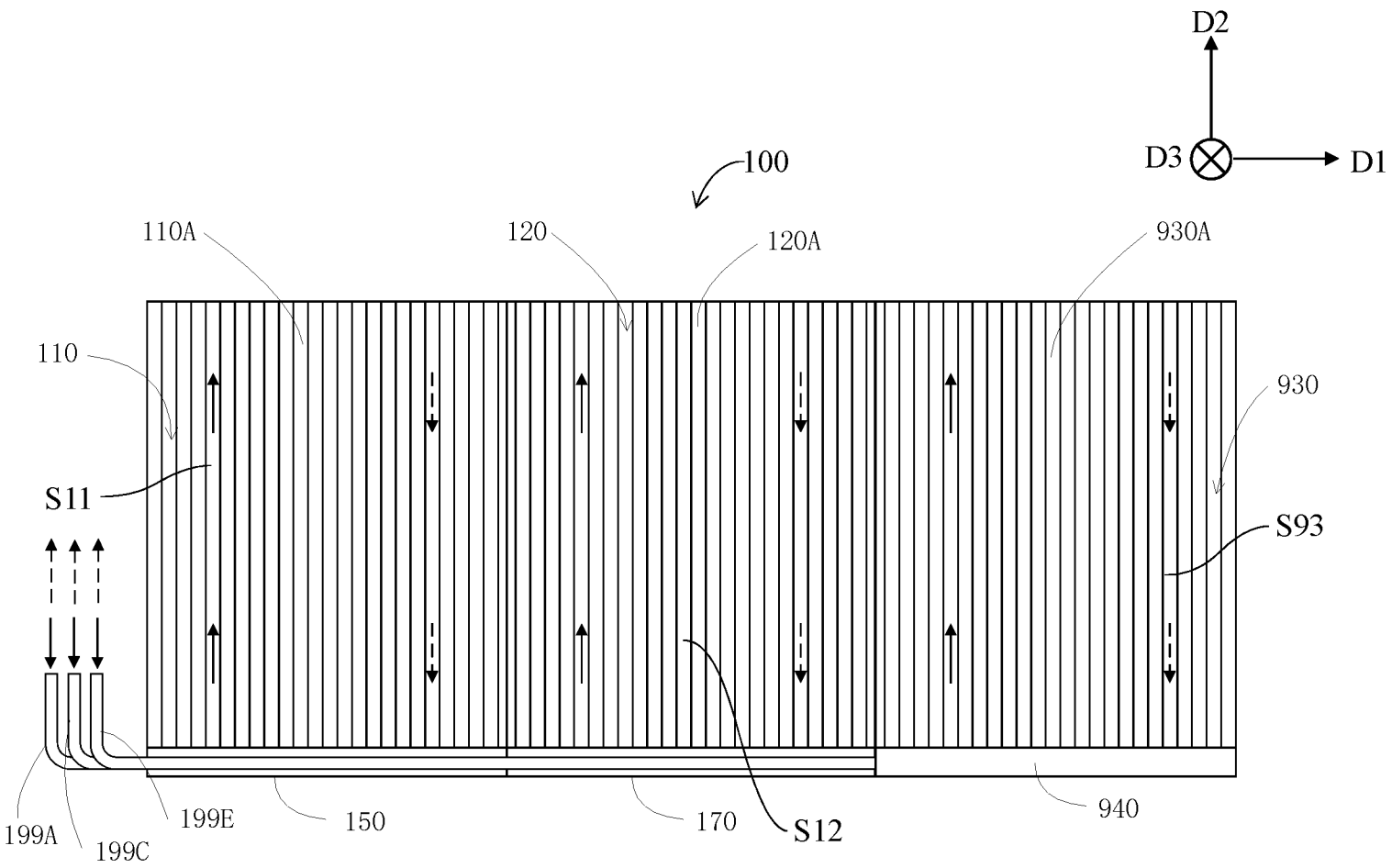
Figure 6:
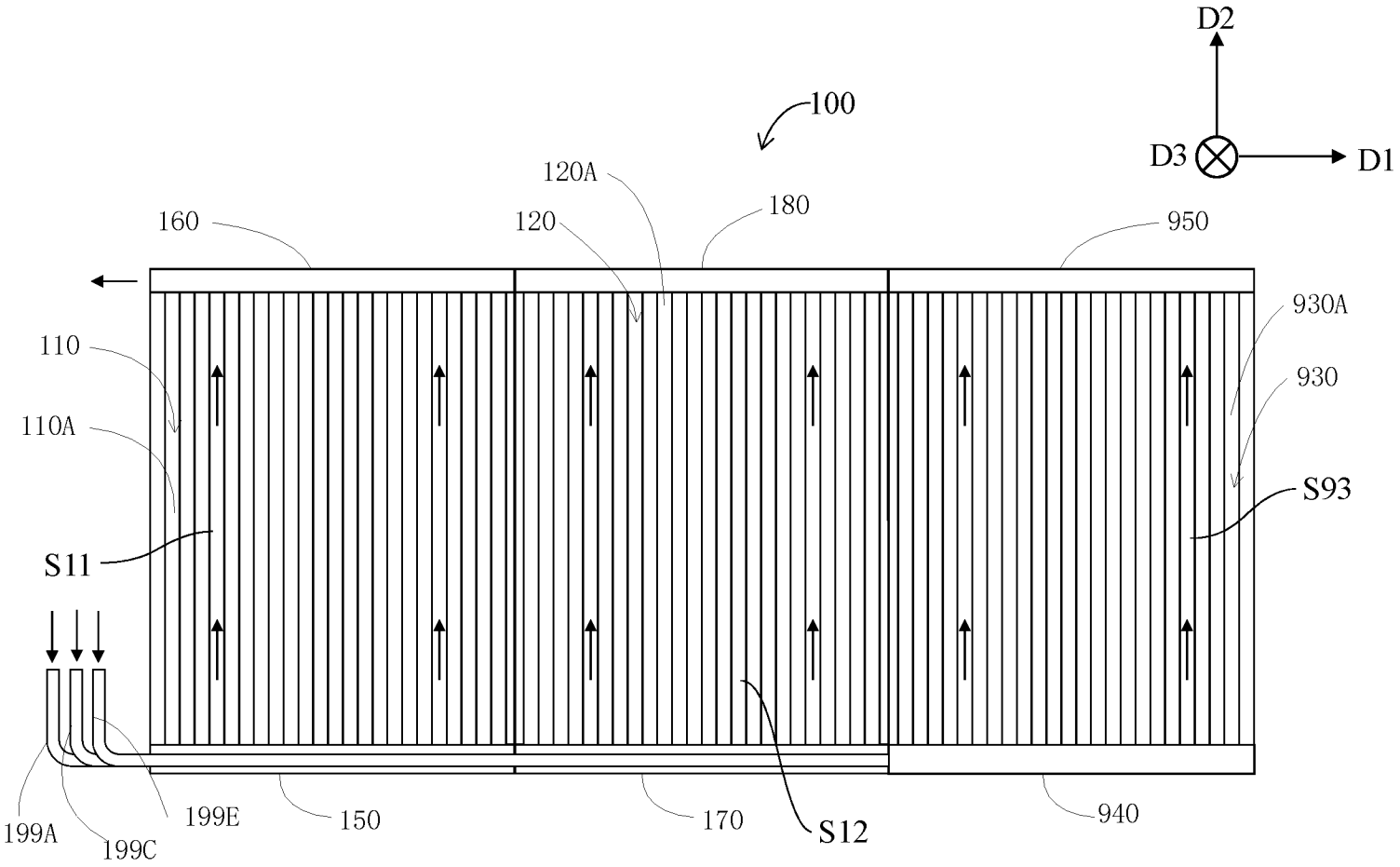

FIG. 5 illustrates a schematic structural diagram of a two-pass heat exchanger including three coils, and FIG. 6 illustrates a structural schematic diagram of a single-pass heat exchanger including three coils. As shown in FIG. 5 and FIG. 6, in other embodiments, the multi-coil microchannel heat exchanger 100 of the present disclosure may further include a third coil 930 in addition to the first coil 110 and the second coil 120. The first coil 110 includes a first inlet header 150, a first outlet header 160, and a plurality of first microchannel tubes 110A, where the first inlet header 150 is in fluid communication with the inlets of the plurality of the first microchannel tubes 110A, the first outlet header 160 is in fluid communication with the outlets of the plurality of the first microchannel tubes 110A. The second coil 120 includes a second inlet header 170, a second outlet header 180, and a plurality of second microchannel tubes 120A, where the second inlet header 170 is in fluid communication with the inlets of the plurality of the second microchannel tubes 120A, the second outlet header 180 is in fluid communication with the outlets of the plurality of the second microchannel tubes 120A. The third coil 930 includes a third inlet header 940, a third outlet header 950, and a plurality of third microchannel tubes 930A, where the third inlet header 940 is in fluid communication with the inlets of the plurality of the third microchannel tubes 930A, and the third outlet header 950 is in fluid communication with the outlets of the plurality of the third microchannel tubes 930A.

In some embodiments, the first coil 110, the second coil 120, and the third coil 930 may have the same structure. Therefore, the structure and manufacturing process of the multi-coil microchannel heat exchanger 100 can be simplified, and the cost can be reduced.

Accordingly, the multi-coil microchannel heat exchanger 100 of the present disclosure further includes a first inlet connector 199A and a first outlet connector, a second inlet connector 199C and a second outlet connector, and a third inlet connector 199E and a third outlet connector (not shown). The first inlet connector 199A is fluidly connected to the first inlet header 150 and the first outlet connector is fluidly connected to the first outlet header 160. The second inlet connector 199C is fluidly connected to the second inlet header 170 and the second outlet connector is fluidly connected to the second outlet header 180. The third inlet connector 199E is fluidly connected to the third inlet header 940 and the third outlet connector is fluidly connected to the third outlet header 950.

In FIGS. 5 and 6, the first coil 110, the second coil 120, and the third coil 930 may be sequentially arranged along the length direction D1 of the multi-coil microchannel heat exchanger 100, and the first coil 110, the second coil 120 and the third coil 930 are also successively arranged along the thickness direction D3 of the multi-coil microchannel heat exchanger 100, such that the first windward surface S11 of the first coil 110, the second windward surface S12 of the second coil 120, and the third windward surface S93 of the third coil 930 are all located on different planes, so as to facilitate the arrangement of the inlet and outlet pipes of the far side coils, without occupying the windward areas of the near side coils. Therefore, the first coil 110, the second coil 120, and the third coil 930 may have the same windward area.

In the two-pass heat exchanger shown in FIG. 5, the first inlet header 150, the first outlet header 160, the first inlet connector 199A, the first outlet connector, the second inlet header 170, the second outlet header 180, the second inlet connector 199C, the second outlet connector, the third inlet header 940, the third outlet header 950, the third inlet connector 199E and the third outlet connector are all located at the bottom (or top) of the multi-coil microchannel heat exchanger 100. The first inlet header 150, the first outlet header 160, the second inlet connector 199C, the second outlet connector, the third inlet connector 199E and the third outlet connector are arranged along the thickness direction D3 of the multi-coil microchannel heat exchanger 100.

In the single pass heat exchanger shown in FIG. 6, the first inlet header 150, the first inlet connector 199A, the second inlet header 170, the second inlet connector 199C, the third inlet header 940, the third inlet connector 199E are all located at the bottom (or top) of the multi-coil microchannel heat exchanger 100; while the first outlet header 160, the first outlet connector, the second outlet header 180, the second outlet connector, the third outlet header 950 and the third outlet connector are all located at the top (or bottom) of the multi-coil microchannel heat exchanger 100. The first inlet header 150, the second inlet connector 199C and the third inlet connector 199E are arranged at the bottom (or top) of the multi-coil microchannel heat exchanger 100 and along the thickness direction D3 of the multi-coil microchannel heat exchanger 100; and the first outlet header 160, the second outlet connector and the third outlet connector are arranged at the top (or bottom) of the multi-coil microchannel heat exchanger 100 and along the thickness direction D3 of the multi-coil microchannel heat exchanger 100.

The multi-coil microchannel heat exchanger 100 of the present disclosure is not limited to include two or three coils. In other embodiments, the multi-coil microchannel heat exchanger 100 of the present disclosure may further include more coils.

Second Embodiment

Figure 7:
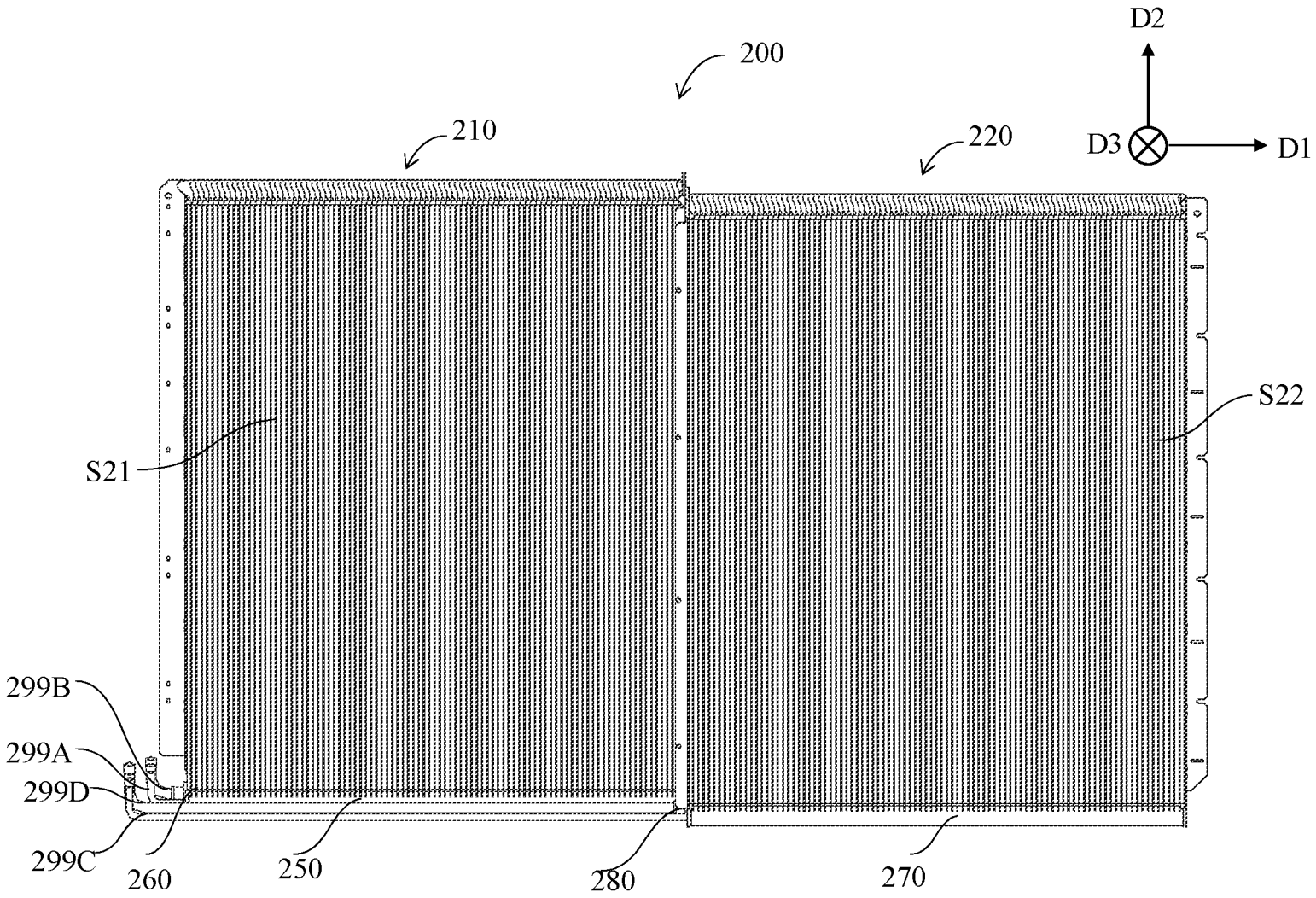
FIG. 7 is a front view of a multi-coil microchannel heat exchanger according to a second embodiment of the present disclosure.
Figure 8:
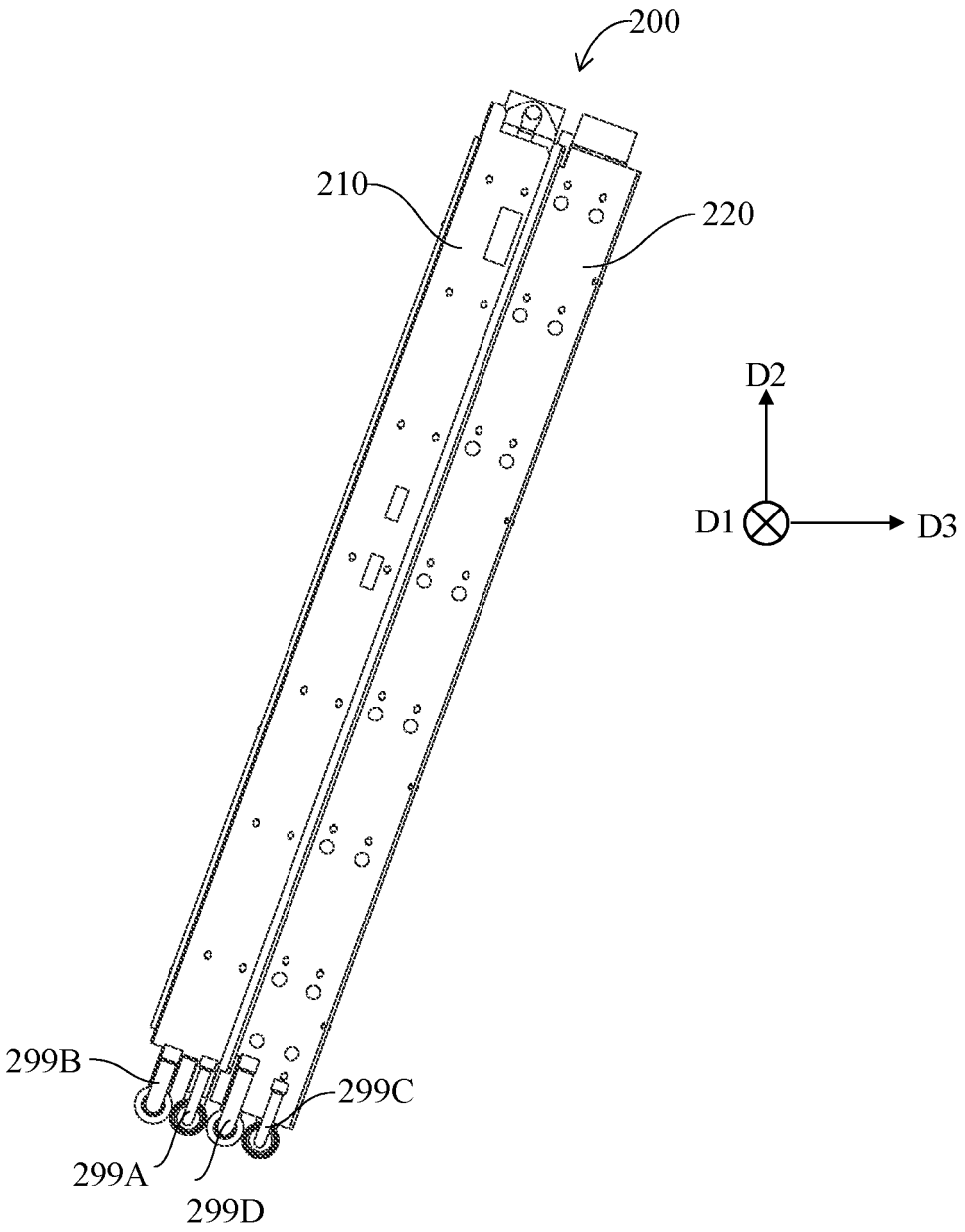
FIG. 8 is a left side view of the multi-coil microchannel heat exchanger according to the second embodiment of the present disclosure.

FIGS. 7 and 8 illustrate schematic diagrams of a multi-coil microchannel heat exchanger 200 according to a second embodiment of the present disclosure, where FIG. 7 illustrates a front view of the multi-coil microchannel heat exchanger 200; FIG. 8 illustrates a left side view of the multi-coil microchannel heat exchanger 200.

As shown in FIG. 7 and FIG. 8, the difference from the multi-coil microchannel heat exchanger 100 of the first embodiment shown in FIGS. 1 to 3 is that in the multi-coil microchannel heat exchanger 100 of the second embodiment shown in FIGS. 7 and 8, viewed along the length direction D1 of the multi-coil microchannel heat exchanger 200, the first windward surface S21 of the first coil 210 and the second windward surface S22 of the second coil 220 are parallel to each other and inclined to the height direction D2 of the multi-coil microchannel heat exchanger 200. Therefore, when the cross-sectional area of the air conditioning unit is constant, the height of the coils can be higher, and the heat exchange area can be larger. The multi-coil microchannel heat exchanger 200 of the second embodiment can have a larger heat exchange area than the multi-coil microchannel heat exchanger 100 of the first embodiment.

FIGS. 7 and 8 show that the multi-coil microchannel heat exchanger 200 according to the second embodiment of the present disclosure may be a two-pass heat exchanger. For a two-pass heat exchanger, the first inlet header 250, the first inlet connector 299A, the second inlet header 270, the second inlet connector 299C, the first outlet header 260, the first outlet connector 299B, the second outlet header 280 and the second outlet connector 299D are all located at the bottom (or top) of the multi-coil microchannel heat exchanger 200. Where the first inlet header 250 and the first outlet header 260 are located at the bottom (or top) of the first coil 210, and the second inlet header 270 and the second outlet header 280 are located at the bottom (or top) of the second coil 220. The first inlet header 250 and the first outlet header 260 of the first coil 210, and the second inlet connector 299C and the second outlet connector 299D may be arranged at the bottom (or top) of the multi-coil microchannel heat exchanger 200 and along the thickness direction D3 of the multi-coil microchannel heat exchanger 200.

When the multi-coil microchannel heat exchanger 200 of the second embodiment of the present disclosure adopts a single-pass heat exchanger, the first inlet header 250, the first inlet connector 299A, the second inlet header 270 and the second inlet connector 299C are located at the bottom (or top) of the multi-coil microchannel heat exchanger 200, while the first outlet header 260, the first outlet connector 299B, the second outlet header 280, and the second outlet connector 299D are located at the top (or bottom) of the multi-coil microchannel heat exchanger 200.

Where the first inlet header 250 is located at the bottom (or top) of the first coil 210, the second inlet header 270 is located at the bottom (or top) of the second coil 220, and the first outlet header 260 is located at the top (or bottom) of the first coil 210, the second outlet header 280 is located at the top (or bottom) of the second coil 220. The second inlet connector 299C located at the far side and the first inlet header 250 of the first coil 210 located at the near side may be arranged at the bottom (or top) of the multi-coil microchannel heat exchanger 200 and along the thickness direction D3 of the multi-coil microchannel heat exchanger 200; the second outlet connector 299D located at the far side and the first outlet header 260 of the first coil 210 located at the near side can be arranged at the top (or bottom) of the multi-coil microchannel heat exchanger 200 and along the thickness direction D3 of the multi-coil microchannel heat exchanger 200.

The multi-coil microchannel heat exchanger 200 of the second embodiment can further increase the windward area of the coil on the basis of shortening the length of the inlet and outlet pipes at the far side.

Third Embodiment

Figure 9:
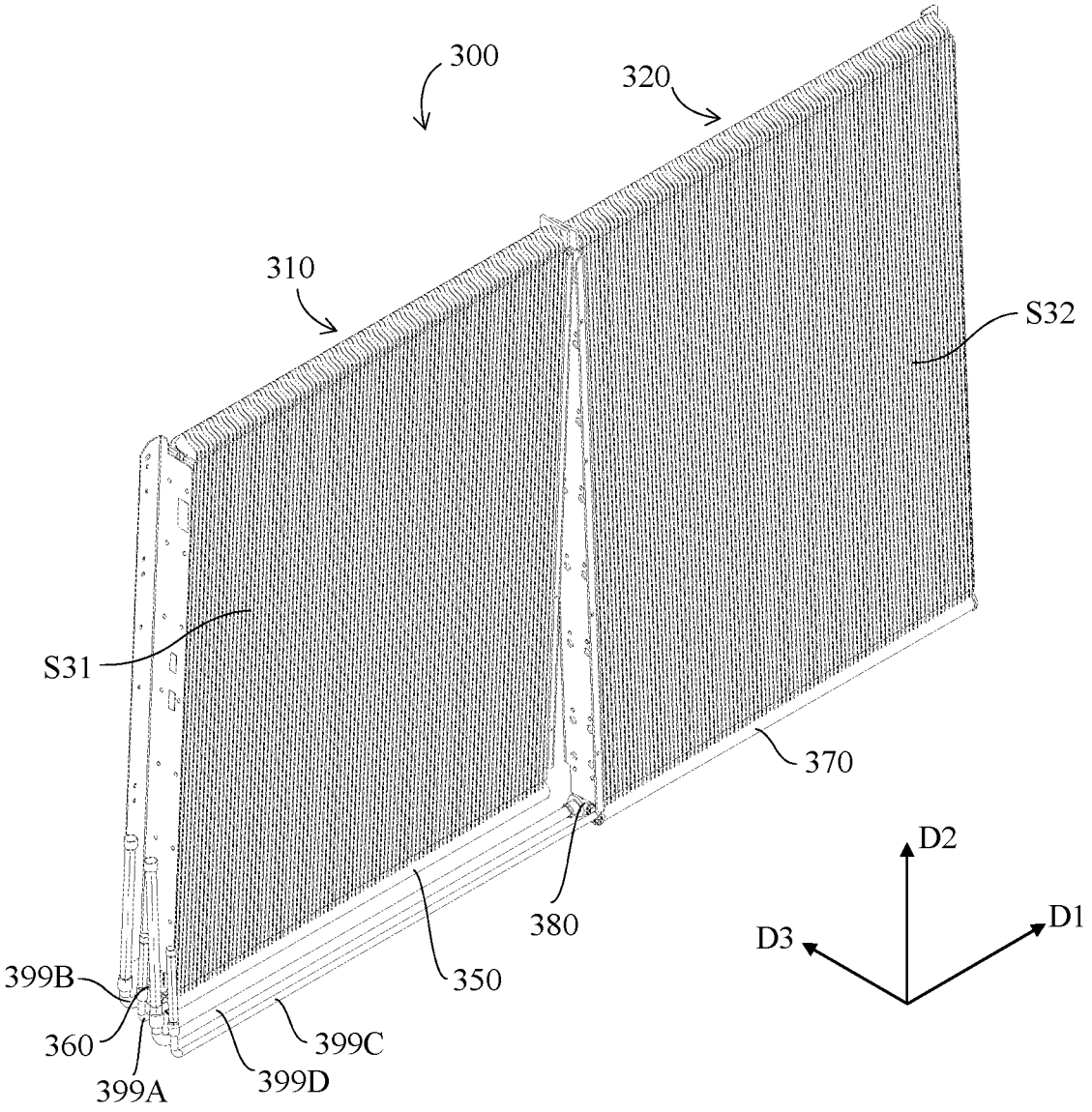
FIG. 9 is a perspective view of a multi-coil microchannel heat exchanger according to a third embodiment of the present disclosure.
Figure 10:
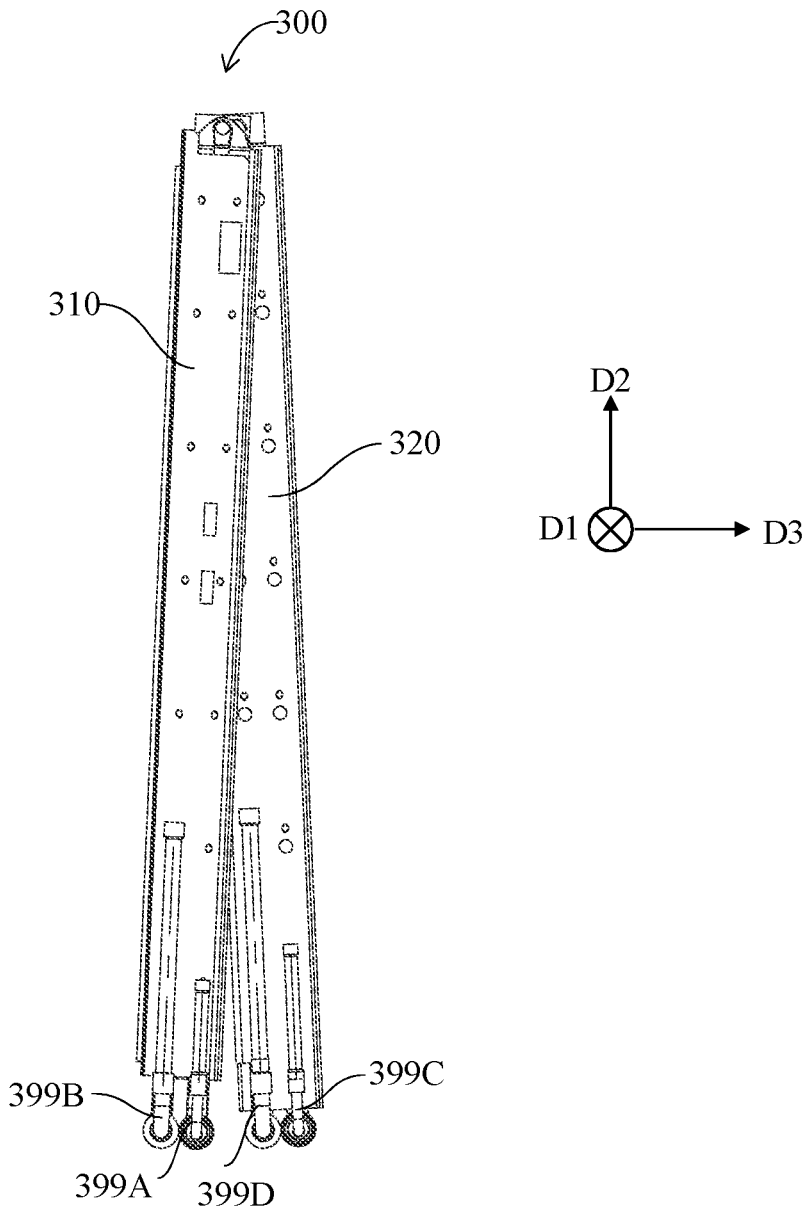
FIG. 10 is a left side view of the multi-coil microchannel heat exchanger according to the third embodiment of the present disclosure.

FIGS. 9 and 10 illustrate schematic diagrams of a multi-coil microchannel heat exchanger 300 according to a third embodiment of the present disclosure, where FIG. 9 illustrates a perspective view of the multi-coil microchannel heat exchanger 300; FIG. 10 illustrates a left side view of the multi-coil microchannel heat exchanger 300.

As shown in FIGS. 9 and 10, the difference from the multi-coil microchannel heat exchanger 100 of the first embodiment shown in FIGS. 1 to 3 is that in the multi-coil microchannel heat exchanger 300 of the third embodiment shown in FIGS. 9 and 10, viewed along the length direction D1 of the multi-coil microchannel heat exchanger 300, the first windward surface S31 of the first coil 310 and the second windward surface S32 of the second coil 320 are cross each other, and the first windward surface S31 and the second windward surface S32 are generally arranged in an inverted V shape. The first coil 310 includes a first upper end and a first lower end along the height direction D2 of the multi-coil microchannel heat exchanger 300, and the second coil 320 includes a second upper end and a second lower end along the height direction D2 of the multi-coil microchannel heat exchanger 300. The first upper end of the first coil 310 and the second upper end of the second coil 320 are aligned in the thickness direction D3 of the multi-coil microchannel heat exchanger 300, and the first lower end of the first coil 310 and the second lower end of the second coil 320 are offset (not overlapped) in the thickness direction D3 of the multi-coil microchannel heat exchanger 300.

Since the first upper end of the first coil 310 and the second upper end of the second coil 320 are aligned in the thickness direction D3 of the multi-coil microchannel heat exchanger 300, the multi-coil microchannel heat exchanger 300 of the third embodiment of the present application adopts a two-pass heat exchanger shown in FIG. 9 and FIG. 10.

As shown in FIGS. 9 and 10, the first inlet header 350, the first inlet connector 399A, the second inlet header 370, the second inlet connector 399C, the first outlet header 360, the first outlet connector 399B, the second outlet header 380 and the second outlet connector 399D are all located at the bottom of the multi-coil microchannel heat exchanger 300. The first inlet header 350 and the first outlet header 360 are located at the bottom of the first coil 310, and the second inlet header 370 and the second outlet header 380 are located at the bottom of the second coil 320. The second inlet connector 399C and the second outlet connector 399D located at the far side may be arranged on one side of the first coil 310 located at the near side along the thickness direction D3 of the multi-coil microchannel heat exchanger 300. Accordingly, the first inlet header 350 and the first outlet header 360 of the first coil 310, and the second inlet connector 399C and the second outlet connector 399D may be respectively arranged along the thickness direction D3 of the multi-coil microchannel heat exchanger 300.

In other embodiments, the first upper end of the first coil 310 and the second upper end of the second coil 320 may also be offset in the thickness direction D3 of the multi-coil microchannel heat exchanger 300, and the first lower end of the first coil 310 and the second lower end of the second coil 320 are aligned in the thickness direction D3 of the multi-coil microchannel heat exchanger 300. Correspondingly, the inlet and outlet pipes of the multi-coil microchannel heat exchanger 300 are arranged at the side with offset arrangement. These equivalent transformations do not change the essence of the present disclosure, and they all fall within the protection scope of the appended claims of the present disclosure.

The multi-coil microchannel heat exchanger 300 of the third embodiment can further increase the windward area of the coil on the basis of shortening the length of the far side inlet and outlet pipes.

Fourth Embodiment

Figure 11:
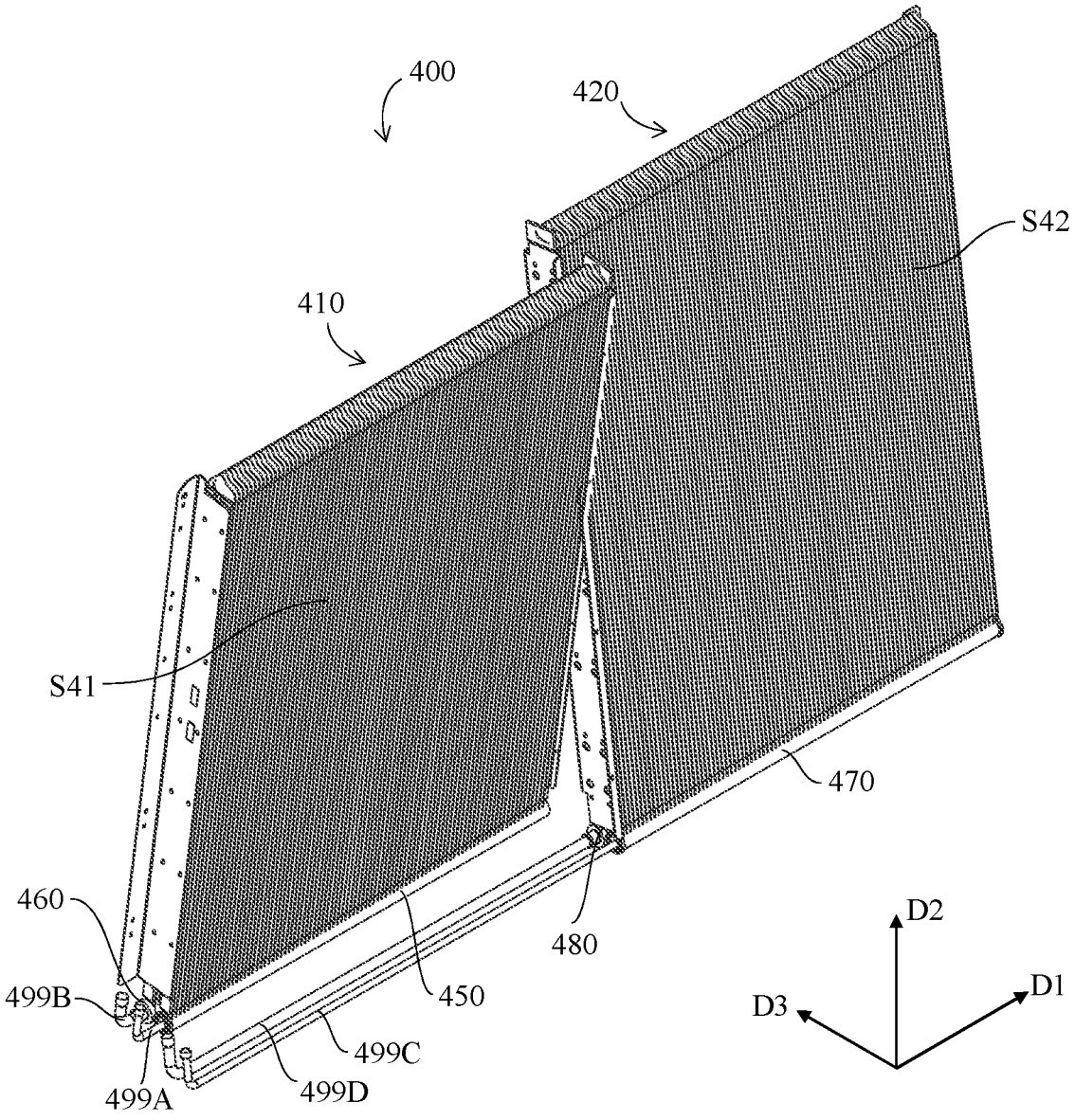
FIG. 11 is a perspective view of a multi-coil microchannel heat exchanger according to a fourth embodiment of the present disclosure.
Figure 12:
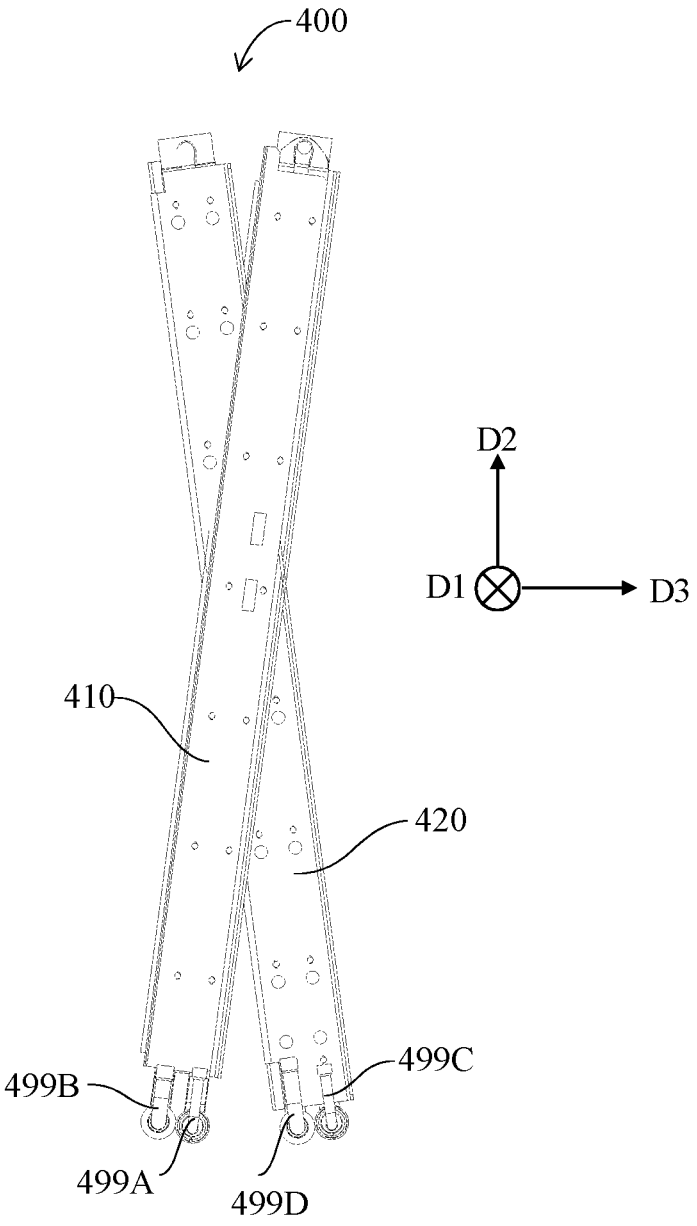
FIG. 12 is a left side view of the multi-coil microchannel heat exchanger according to the fourth embodiment of the present disclosure.

FIGS. 11 and 12 illustrate diagrams of a multi-coil microchannel heat exchanger 400 according to a fourth embodiment of the present disclosure, where FIG. 11 illustrates a perspective view of the multi-coil microchannel heat exchanger 400; FIG. 9 illustrates a left side view of the multi-coil microchannel heat exchanger 400.

As shown in FIGS. 11 and 12, the difference from the multi-coil microchannel heat exchanger 300 of the third embodiment shown in FIGS. 9 and 10 is that in the multi-coil microchannel heat exchanger 400 of the fourth embodiment shown in FIGS. 11 and 12, viewed along the length direction D1 of the multi-coil microchannel heat exchanger 400, the first windward surface S41 of the first coil 410 and the second windward surfaces S42 of the second coil 420 cross each other, and the first windward surface S41 and the second windward surface S42 are generally arranged in an X shape. The first coil 410 includes a first upper end and a first lower end along the height direction D2 of the multi-coil microchannel heat exchanger 400, and the second coil 420 includes a second upper end and a second lower end along the height direction D2 of the multi-coil microchannel heat exchanger 400. The first upper end of the first coil 410 and the second upper end of the second coil 420 are offset (not overlapped) in the thickness direction D3 of the multi-coil microchannel heat exchanger 400, and the first lower end of the first coil 410 and the second lower end of the second coil 420 are also offset (not overlapped) in the thickness direction D3 of the multi-coil microchannel heat exchanger 400.

FIGS. 11 and 12 show that the multi-coil microchannel heat exchanger 400 according to the fourth embodiment of the present disclosure may be a two-pass heat exchanger. For a two-pass heat exchanger, the first inlet header 450, the first inlet connector 499A, the second inlet header 470, the second inlet connector 499C, the first outlet header 460, the first outlet connector 499B, the second outlet header 480 and the second outlet connector 499D are all located at the bottom (or top) of the multi-coil microchannel heat exchanger 400. The first inlet header 450 and the first outlet header 460 are located at the bottom (or top) of the first coil 410, and the second inlet header 470 and the second outlet header 480 are located at the bottom (or top) of the second coil 420. The first inlet header 450 and first outlet header 460 of the first coil 410, and the second inlet connector 499C and second outlet connector 499D may be arranged at the bottom (or top) of the multi-coil microchannel heat exchanger 400 and along the thickness direction D3 of the multi-coil microchannel heat exchanger 400.

When the multi-coil microchannel heat exchanger 400 of the fourth embodiment of the present disclosure adopts a single pass heat exchanger, the first inlet header 450, the first inlet connector 499A, the second inlet header 470 and the second inlet Connector 499C are located at the bottom (or top) of multi-coil microchannel heat exchanger 400, while the first outlet header 460, the first outlet connector 499B, the second outlet header 480 and the second outlet connector 499D are located at the top (or bottom) of the multi-coil microchannel heat exchanger 400. Where the first inlet header 450 is located at the bottom (or top) of the first coil 410, the second inlet header 470 is located at the bottom (or top) of the second coil 420, and the second inlet connector 499C located at the far side is located at one side of the first inlet header 450 along the thickness direction D3 of the multi-coil microchannel heat exchanger 400, the second inlet connector 499C located at the far side and the first inlet header 450 of the first coil 410 located at the near side are arranged at the bottom (or top) of the multi-coil microchannel heat exchanger 400 and along the thickness direction D3 of the multi-coil microchannel heat exchanger 400; the first outlet header 460 is located at the top (or bottom) of the first coil 410, the second outlet header 480 is located at the top (or bottom) of the second coil 420, and the second outlet connector 499D is located at another side of the first outlet header 460 along the thickness direction D3 of the multi-coil microchannel heat exchanger 400, the second outlet connector 499D located at the far side and the first outlet header 460 of the first coil 410 located at the near side are arranged at the top (or bottom) of the multi-coil microchannel heat exchanger 400 and along the thickness direction D3 of the multi-coil microchannel heat exchanger 400.

The multi-coil microchannel heat exchanger 400 of the fourth embodiment can further increase the windward area of the coils on the basis of shortening the length of the far side inlet and outlet pipes.

Fifth Embodiment

Figure 13:
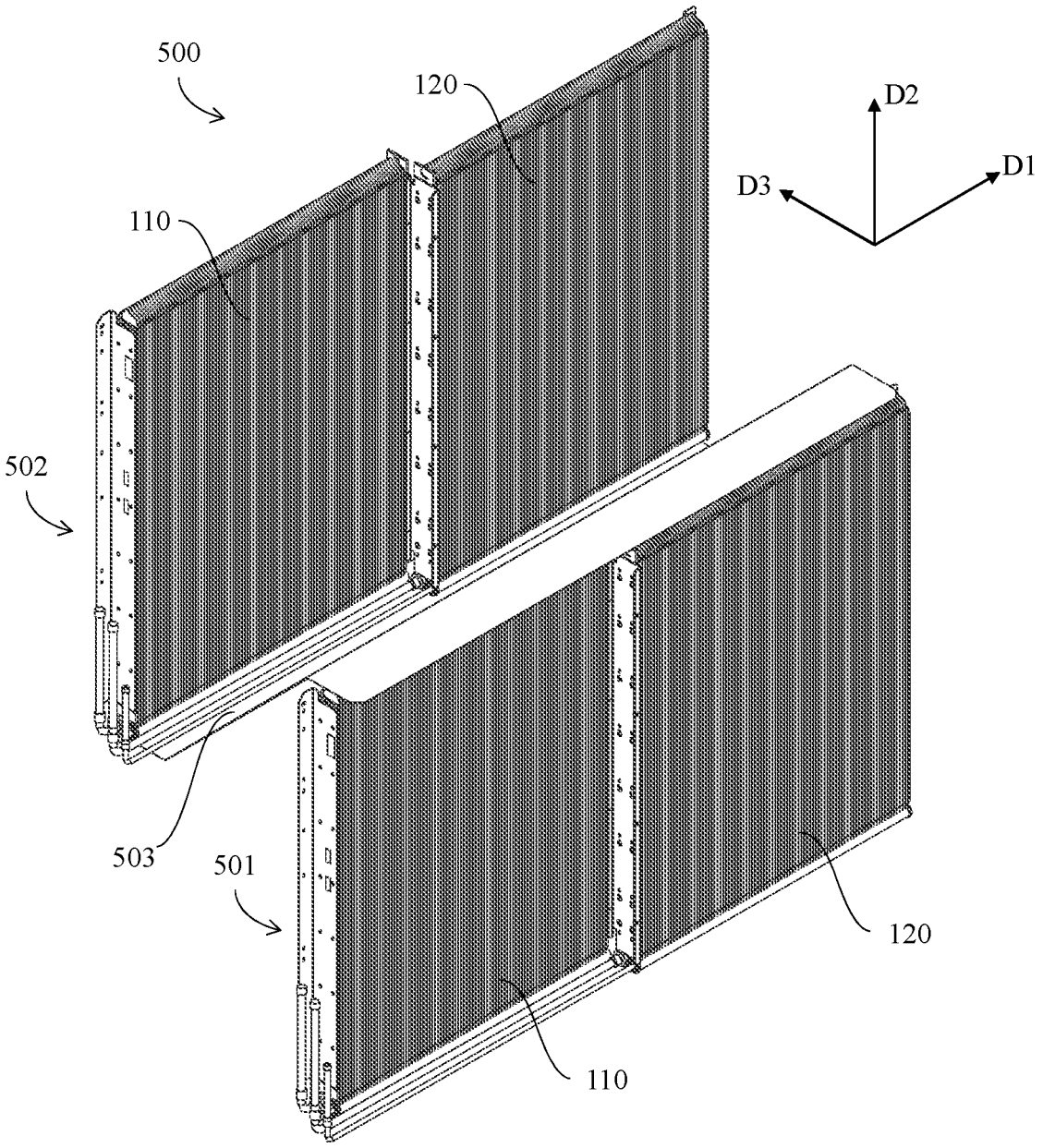
FIG. 13 is a perspective view of a multi-coil microchannel heat exchanger according to a fifth embodiment of the present disclosure.
Figure 14:
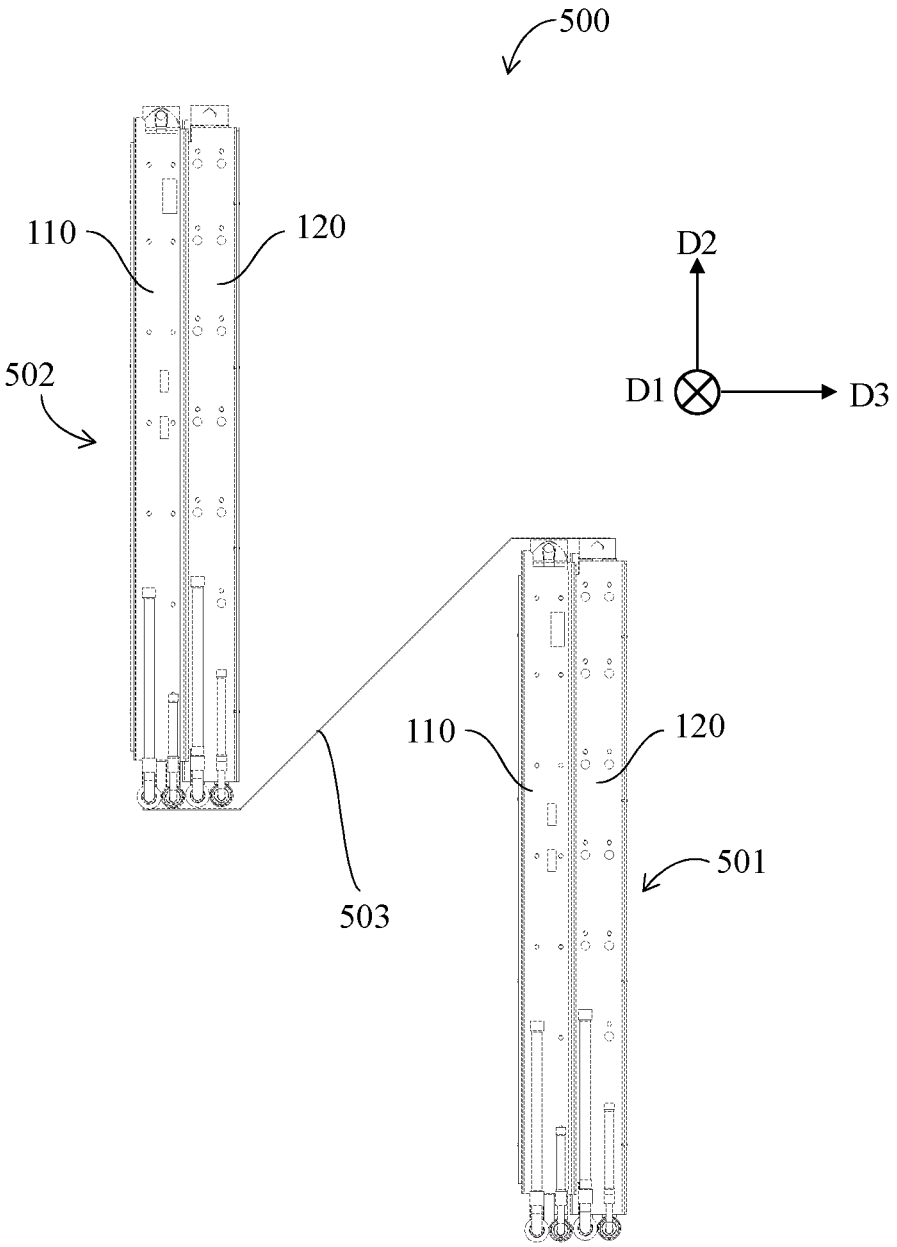
FIG. 14 is a left side view of the multi-coil microchannel heat exchanger according to the fifth embodiment of the present disclosure.

FIGS. 13 and 14 illustrate diagrams of a multi-coil microchannel heat exchanger 500 according to a fifth embodiment of the present disclosure, where FIG. 13 illustrates a perspective view of the multi-coil microchannel heat exchanger 500; FIG. 14 illustrates a left side view of the multi-coil microchannel heat exchanger 500.

As shown in FIGS. 13 and 14, the multi-coil microchannel heat exchanger 500 includes at least one layer of coils, each layer of coils includes at least two coils, and the at least two coils are successively arranged along the length direction D1 of the multi-coil microchannel heat exchanger 500, and the at least two coils include the first coil 110 and the second coil 120.

In FIGS. 13 and 14, the multi-coil microchannel heat exchanger 500 includes two layers of coils, a first layer of coils 501 and a second layer of coils 502. Each layer of coils has a substantially similar structure to the multi-coil microchannel heat exchanger 100 of the first embodiment shown in FIGS. 1 to 3. The coils of the same layer in the first layer of coils 501 and the second layer of coils 502 are arranged offset from each other in the thickness direction D3 of the multi-coil microchannel heat exchanger 500. The difference from the multi-coil microchannel heat exchanger 100 of the first embodiment shown in FIGS. 1 to 3 is that in the multi-coil microchannel heat exchanger 500 of the fifth embodiment shown in FIGS. 13 and 14, the first layer of coils 501 and the second layer of coils 502 are arranged offset from each other in the height direction D2 of the multi-coil microchannel heat exchanger 500. That is, the first layer of coils 501 and the second layer of coils 502 are located at different heights, and the first layer of coils 501 and the second layer of coils 502 partially overlap in the height direction D2 of the multi-coil microchannel heat exchanger 500.

By arranging the two-layer coils in the height direction D2 of the multi-coil microchannel heat exchanger 500 in this offset arrangement, the cross-sectional area of the entire air conditioning unit can be fully utilized, and the first layer of coils 501 located at the outer layer has little effect on the windward area of the second layer of coils 502 located in the inner layer. Therefore, the second layer of coils 502 located at the inner side can also have a large windward area, thereby the entire windward area of the multi-coil microchannel heat exchanger 500 can be increased as much as possible.

In some embodiments, the first layer of coils 501 and the second layer of coils 502 may be the same. Therefore, the multi-coil microchannel heat exchanger 500 of the fifth embodiment of the present disclosure can be formed by using same coils, thereby greatly simplifying the structure, simplifying the manufacturing and production processes, and reducing costs.

In some embodiments, the multi-coil microchannel heat exchanger 500 may further include a deflector 503, and the deflector 503 is connected to the upper end of the first layer of coils 501 and the lower end of the second layer of coils 502. The deflector 503 is inclined, such that a larger V-shape wind collector can be formed on the windward side of the second layer of coils 502 located at the inner side, so as to increase the flow of external fluid, and further, increase the windward area of the second layer of coils 502 located at the inner side.

The multi-coil microchannel heat exchanger 500 of the fifth embodiment, on the basis of shortening the length of the far side inlet and outlet pipes, can make full use of the cross-sectional area of the air conditioning unit, can further increase the windward area of the coils, can meet larger heat exchange requirements and is suitable for larger tonnage air

Sixth Embodiment

Figure 15:
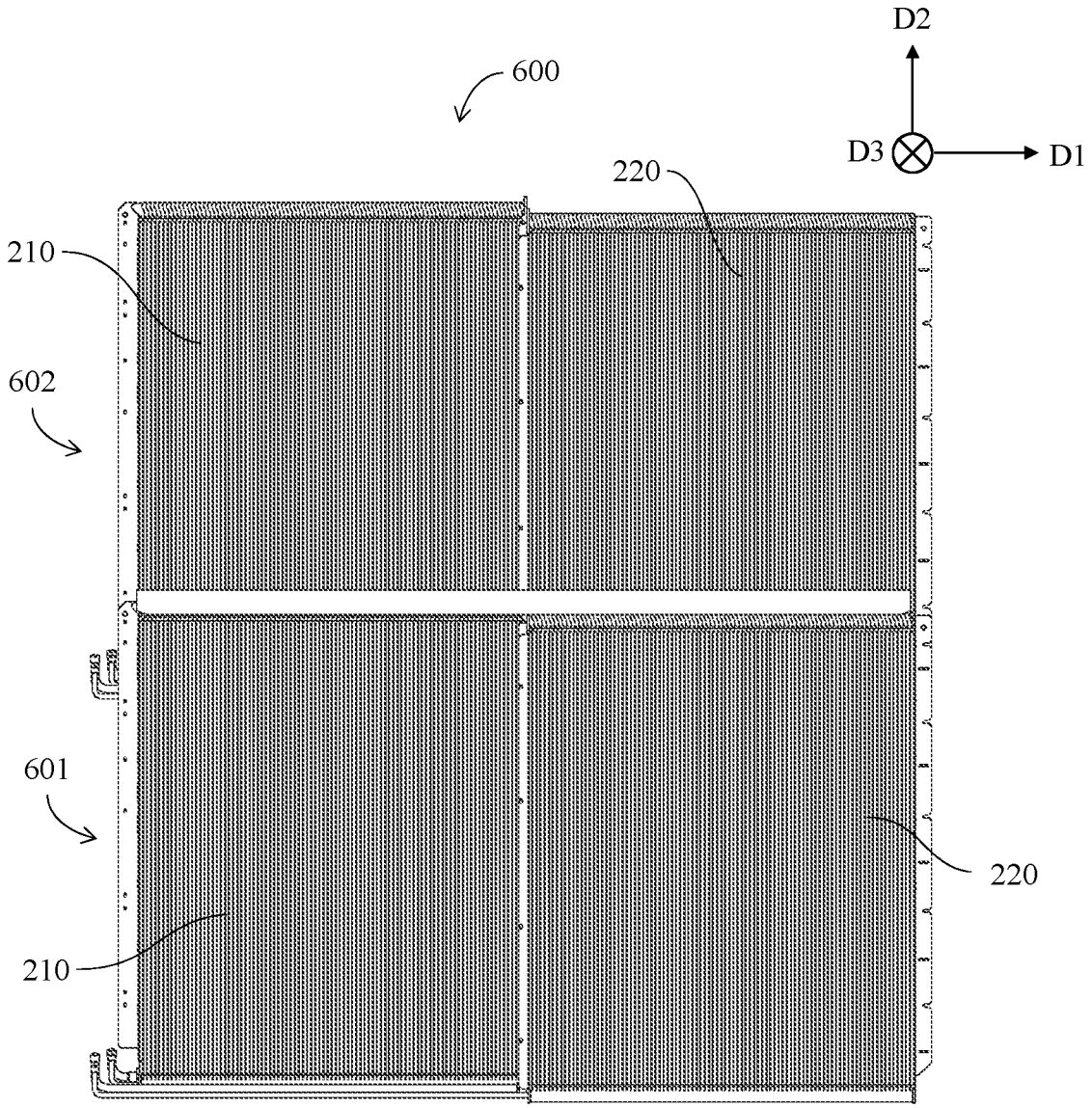
FIG. 15 is a front view of a multi-coil microchannel heat exchanger according to a sixth embodiment of the present disclosure.
Figure 16:
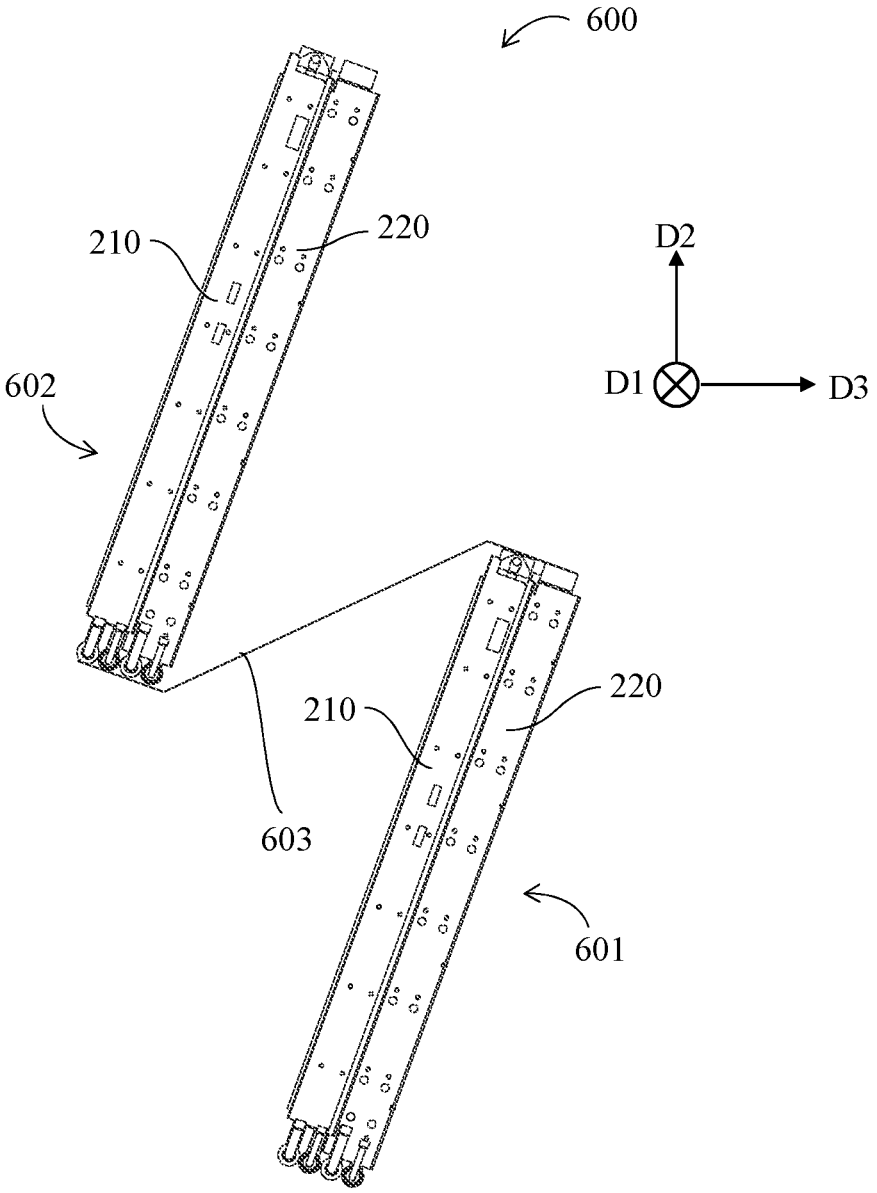
FIG. 16 is a left side view of the multi-coil microchannel heat exchanger according to the sixth embodiment of the present disclosure.

FIGS. 15 and 16 illustrate diagrams of a multi-coil microchannel heat exchanger 600 according to a sixth embodiment of the present disclosure, where FIG. 15 illustrates a front view of the multi-coil microchannel heat exchanger 600; FIG. 16 illustrates a left side view of the multi-coil microchannel heat exchanger 600.

In FIGS. 15 and 16, the multi-coil microchannel heat exchanger 600 includes two layers of coils, a first layer of coils 601 and a second layer of coils 602. Each layer of coils has a substantially similar structure to the multi-coil microchannel heat exchanger 200 of the second embodiment shown in FIGS. 7 and 8. The difference from the multi-coil microchannel heat exchanger 200 of the second embodiment shown in FIGS. 7 and 8 is that, in the multi-coil microchannel heat exchanger 600 of the sixth embodiment shown in FIGS. 15 and 16, the first layer of coils 601 and the second layer of coils 602 are arranged offset from each other in the height direction D2 of the multi-coil microchannel heat exchanger 600.

By arranging the two layers of coils offset from each other in the height direction D2 of the multi-coil microchannel heat exchanger 600, the entire cross-sectional area of the air conditioning unit can be fully utilized, the outer first layer of coils 601 has little effect on the windward area of the inner second layer of coils 602, so the inner second layer of coils 602 can also maintain a larger windward area. Thus, the entire windward area of the multi-coil microchannel heat exchanger 600 can be increased as much as possible.

In some embodiments, the first layer of coils 601 and the second layer of coils 602 may be same. Therefore, the multi-coil microchannel heat exchanger 600 of the sixth embodiment of the present disclosure can be formed by using same coils, thereby greatly simplifying the structure, simplifying the manufacturing and production processes, and reducing costs.

In some embodiments, the multi-coil microchannel heat exchanger 600 may further include a deflector 603, and the deflector 603 connects the upper end of the first layer of coils 601 and the lower end of the second layer of coils 602. The deflector 603 is inclined, such that a larger V-shape wind collector can be formed on the windward side of the inner second layer of coils 602, so as to increase the flow of the external fluid, and further, increase the windward area of the inner second layer of coils 602.

The multi-coil microchannel heat exchanger 600 of the sixth embodiment, on the basis of shortening the length of the far side inlet and outlet pipes, can make full use of the cross-sectional area of the air conditioning unit, can further increase the windward area of the coils, can meet larger heat exchange requirements and is suitable for larger tonnage air

Seventh Embodiment

Figure 17:
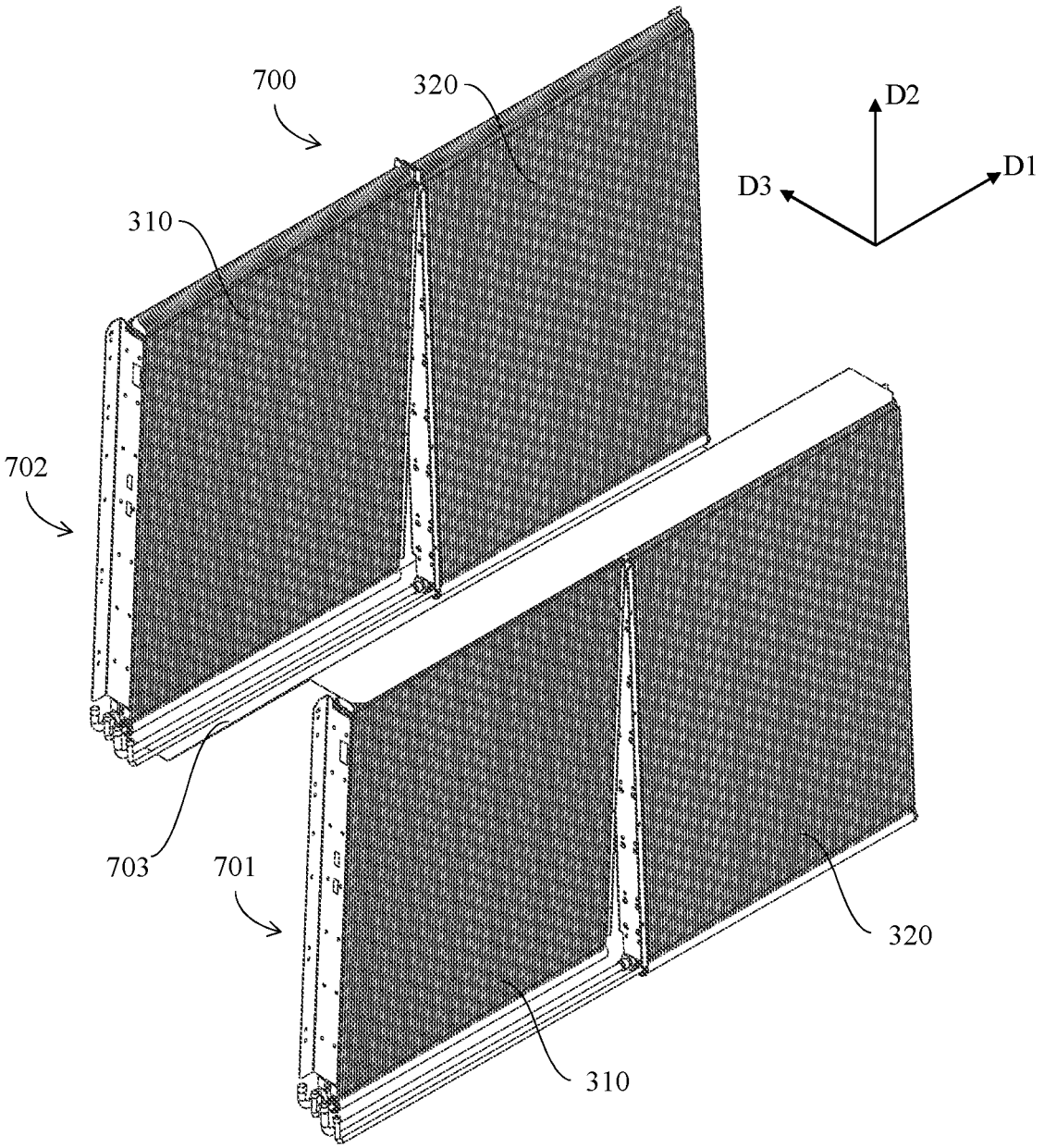
FIG. 17 is a perspective view of a multi-coil microchannel heat exchanger according to a seventh embodiment of the present disclosure.
Figure 18:
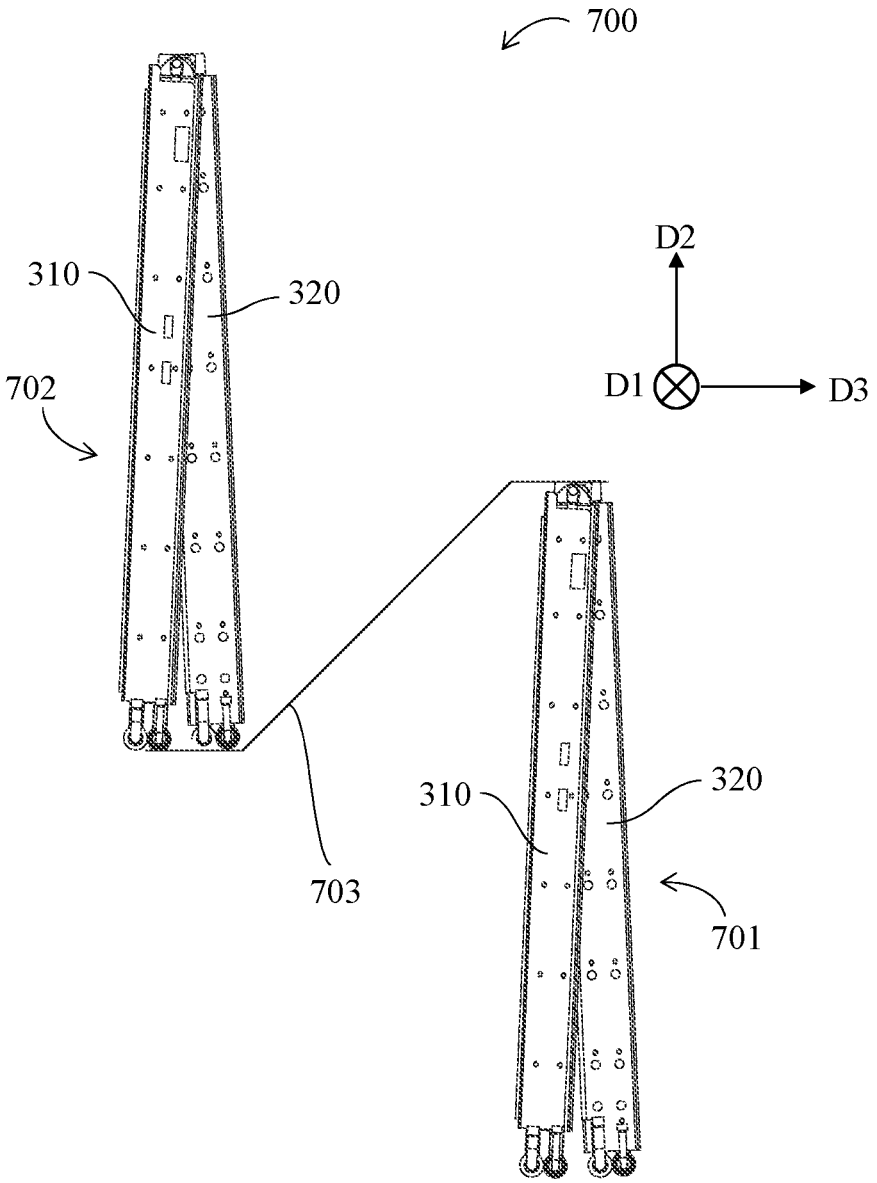
FIG. 18 is a left side view of the multi-coil microchannel heat exchanger according to the seventh embodiment of the present disclosure.

FIGS. 17 and 18 illustrate diagrams of a multi-coil microchannel heat exchanger 700 according to a seventh embodiment of the present disclosure, where FIG. 17 illustrates a perspective view of the multi-coil microchannel heat exchanger 700; FIG. 18 illustrates a left side view of the multi-coil microchannel heat exchanger 700.

In FIGS. 17 and 18, the multi-coil microchannel heat exchanger 700 includes two layers of coils, a first layer of coils 701 and a second layer of coils 702. Each layer of coils has a generally similar structure to the multi-coil microchannel heat exchanger 300 of the third embodiment shown in FIGS. 9 and 10. The difference from the multi-coil microchannel heat exchanger 300 of the third embodiment shown in FIGS. 9 and 10 is that in the multi-coil microchannel heat exchanger 700 of the seventh embodiment shown in FIGS. 17 and 18, the first layer of coils 701 and the second layer of coils 702 are arranged offset from each other in the height direction D2 of the multi-coil microchannel heat exchanger 700.

By arranging the two layers of coils offset from each other in the height direction D2 of the multi-coil microchannel heat exchanger 700, the entire cross-sectional area of the air conditioning unit can be fully utilized, the outer first layer of coils 701 has little effect on the windward area of the inner second layer of coils 702, so the inner second layer of coils 702 can also maintain a larger windward area. Thus, the entire windward area of the multi-coil microchannel heat exchanger 700 can be increased as much as possible.

In some embodiments, the first layer of coils 701 and the second layer of coils 702 may be same. Therefore, the multi-coil microchannel heat exchanger 700 of the seventh embodiment of the present disclosure can be formed by using same coils, thereby greatly simplifying the structure, simplifying the manufacturing and production processes, and reducing costs.

In some embodiments, the multi-coil microchannel heat exchanger 700 may further include a deflector 703, and the deflector 703 connects the upper end of the first layer of coils 701 and the lower end of the second layer of coils 702. The deflector 703 is inclined, such that a larger V-shape wind collector can be formed on the windward side of the inner second layer of coils 702, so as to increase the flow of the external fluid, and further, increase the windward area of the inner second layer of coils 702.

Figure 19:
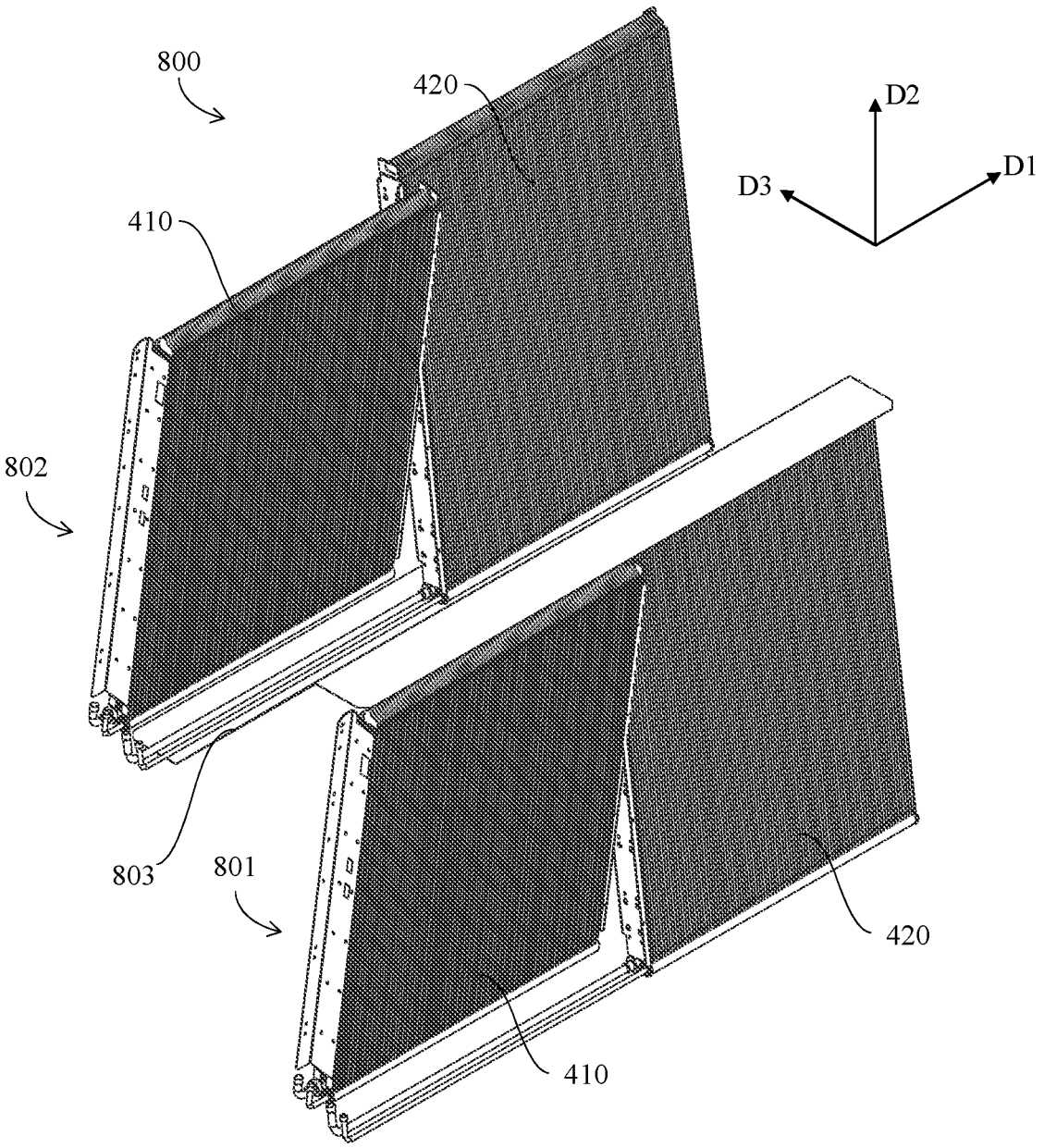
FIG. 19 is a perspective view of a multi-coil microchannel heat exchanger according to an eighth embodiment of the present disclosure.
Figure 20:
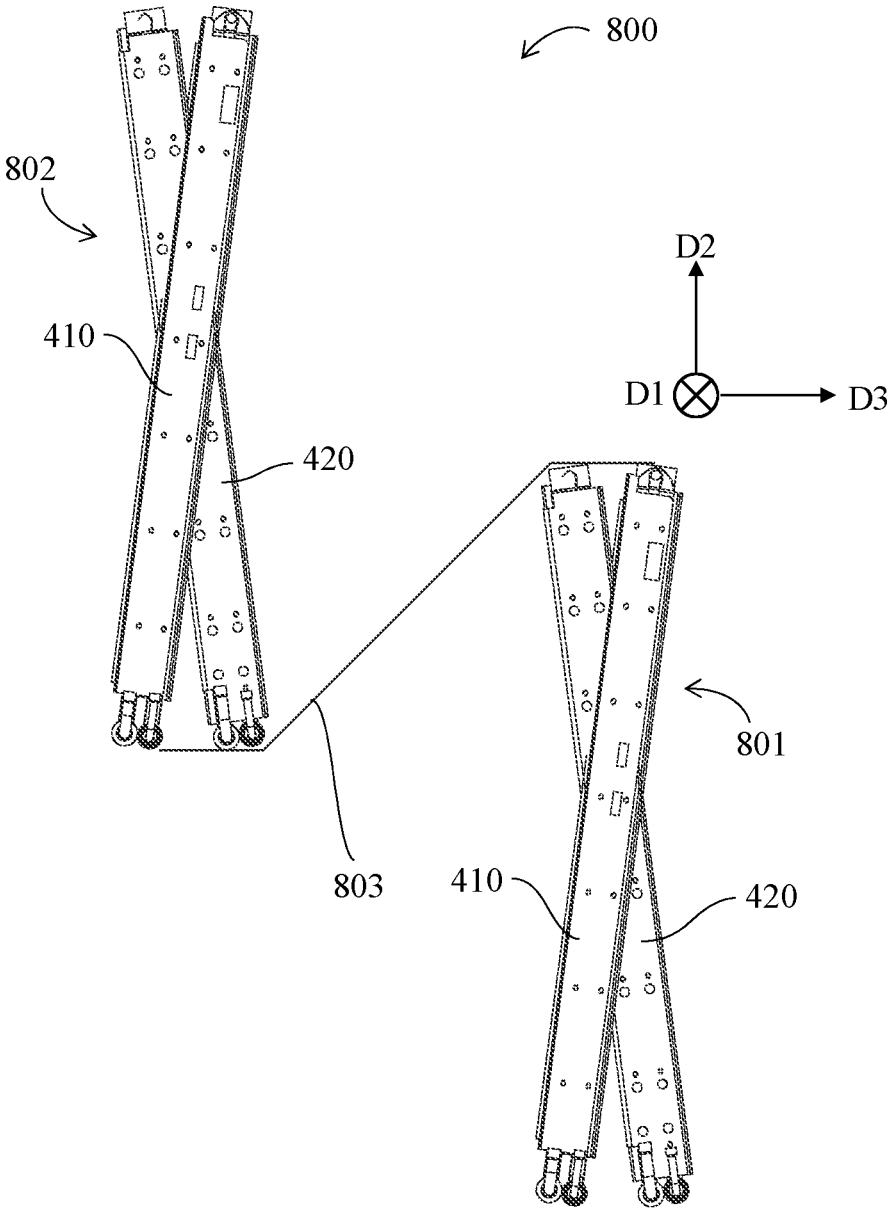
FIG. 20 is a left side view of the multi-coil microchannel heat exchanger according to the eighth embodiment of the present disclosure.

The multi-coil microchannel heat exchanger 700 of the seventh embodiment, on the basis of shortening the length of the far side inlet and outlet pipes, can make full use of the cross-sectional area of the air conditioning unit, can further increase the windward area of the coils, can meet larger heat exchange requirements and is suitable for larger tonnage air Eighth Embodiment FIGS. 19 and 20 illustrate diagrams of a multi-coil microchannel heat exchanger 800 according to an eighth embodiment of the present disclosure, where FIG. 19 illustrates a perspective view of the multi-coil microchannel heat exchanger 800; FIG. 20 illustrates a left side view of the multi-coil microchannel heat exchanger 800.

In FIGS. 19 and 20, the multi-coil microchannel heat exchanger 800 includes two layers of coils, a first layer of coils 801 and a second layer of coils 802. Each layer of coils has a generally similar structure to the multi-coil microchannel heat exchanger 400 of the fourth embodiment shown in FIGS. 11 and 12. The difference from the multi-coil microchannel heat exchanger 400 of the fourth embodiment shown in FIGS. 11 and 12 is that in the multi-coil microchannel heat exchanger 800 of the eighth embodiment shown in FIGS. 19 and 20, the first layer of coils 801 and the second layer of coils 802 are arranged offset from each other in the height direction D2 of the multi-coil microchannel heat exchanger 800.

By arranging the two layers of coils offset from each other in the height direction D2 of the multi-coil microchannel heat exchanger 800, the entire cross-sectional area of the air conditioning unit can be fully utilized, the outer first layer of coils 801 has little effect on the windward area of the inner second layer of coils 802, so the inner second layer of coils 802 can also maintain a larger windward area. Thus, the entire windward area of the multi-coil microchannel heat exchanger 800 can be increased as much as possible.

In some embodiments, the first layer of coils 801 and the second layer of coils 802 may be same. Therefore, the multi-coil microchannel heat exchanger 800 of the eighth embodiment of the present disclosure can be formed by using same coils, thereby greatly simplifying the structure, simplifying the manufacturing and production processes, and reducing costs.

In some embodiments, the multi-coil microchannel heat exchanger 800 may further include a deflector 803, and the deflector 803 connects the upper end of the first layer of coils 801 and the lower end of the second layer of coils 802. The deflector 803 is inclined, such that a larger V-shape wind collector can be formed on the windward side of the inner second layer of coils 802, so as to increase the flow of the external fluid, and further, increase the windward area of the inner second layer of coils 802.

The multi-coil microchannel heat exchanger 800 of the eighth embodiment, on the basis of shortening the length of the far side inlet and outlet pipes, can make full use of the cross-sectional area of the air conditioning unit, can further increase the windward area of the coils, can meet larger heat exchange requirements and is suitable for larger tonnage air Multiple embodiments of the multi-coil microchannel heat exchanger of the present disclosure are listed above, however, the multi-coil microchannel heat exchanger of the present disclosure is not limited to the above embodiments. In summary of the above embodiments, the multi-coil microchannel heat exchanger of the present disclosure may include one or more layers of coils arranged along the height direction D2 of the multi-coil microchannel heat exchanger. Each layer of coils may include essentially two or more coils sequentially arranged along the length direction D1 of the multi-coil microchannel heat exchanger.

Where, for the same layer of coils, the windward surfaces of all coils in the same layer are located on different planes, such that the far side inlet/outlet connectors do not need to pass through the bottom of the near side coils, but can extend from one side of the near side coil in the thickness direction D3 of the multi-coil microchannel heat exchanger, and the far side inlet/outlet connectors and near side coil inlet/outlet headers can be arranged along the thickness direction D3 of the multi-coil microchannel heat exchanger. Therefore, without reducing the height of the near side coils, the windward areas of the near side coils can be increased.

As for different layers of coils, the different layers of coils are arranged offset from each other in the height direction D2 of the multi-coil microchannel heat exchanger. That is, the different layers of coils are respectively located at different heights, and adjacent layers of coils partially overlap in the height direction D2 of the multi-coil microchannel heat exchanger.

The present disclosure further provides an air conditioning unit. The air conditioning unit may include at least one of the multi-coil microchannel heat exchangers 100-800 described in the above embodiments.

The multi-coil microchannel heat exchangers 100-800 and the air conditioning unit with at least one of the multi-coil microchannel heat exchangers 100-800 described in the various embodiments of the present disclosure, on the basis of shortening the length of the far side inlet and outlet pipes, can increase the windward area of the coils.

The multi-coil microchannel heat exchangers and the air conditioning unit provided in the embodiments of the present disclosure have been described in detail above. Specific examples are used herein to describe the multi-coil microchannel heat exchangers and the air conditioning unit of the embodiments of the present disclosure. The descriptions of the above embodiments are only used to help understand the core idea of the present disclosure, and are not intended to limit the present disclosure. For those of ordinary skill in the art, without departing from the spirit and principle of the present disclosure, several improvements and modifications can also be made to the present disclosure, and such improvements and modifications should also fall within the protection scope of the appended claims of the present disclosure.

The invention claimed is:

1. A multi-coil microchannel heat exchanger, comprising:

a first coil comprising a first inlet header, a first outlet header, and first microchannel tubes, wherein the first inlet header and the first outlet header both extend along a length direction of the multi-coil microchannel heat exchanger, each of the first microchannel tubes comprises an inlet and an outlet, the first inlet header is in fluid communication with the inlets of the first microchannel tubes, and the first outlet header is in fluid communication with the outlets of the first microchannel tubes;

a second coil comprising a second inlet header, a second outlet header, and second microchannel tubes, wherein the second inlet header and the second outlet header both extend along the length direction of the multi-coil microchannel heat exchanger, each of the second microchannel tubes comprises an inlet and an outlet, the second inlet header is in fluid communication with the inlets of the second microchannel tubes, and the second outlet header is in fluid communication with the outlets of the second microchannel tubes;

a first inlet connector, fluidly connected to the first inlet header;

a first outlet connector, fluidly connected to the first outlet header;

a second inlet connector, fluidly connected to the second inlet header; and a second outlet connector, fluidly connected to the second outlet header, wherein the first coil and the second coil are arranged successively along the length direction of the multi-coil microchannel heat exchanger, the multi-coil microchannel heat exchanger comprises a first side and a second side along the length direction, the first inlet connector, the first outlet connector, the second inlet connector and the second outlet connector are all located at the first side, and the first coil comprises a first windward surface, the second coil comprises a second windward surface, and the first windward surface and the second windward surface are respectively located on different planes.

2. The multi-coil microchannel heat exchanger according to claim 1, wherein the second inlet connector and the first inlet header are arranged along a thickness direction of the multi-coil microchannel heat exchanger, the second outlet connector and the first outlet header are arranged along the thickness direction of the multi-coil microchannel heat exchanger.

3. The multi-coil microchannel heat exchanger according to claim 1, wherein viewed along the length direction of the multi-coil microchannel heat exchanger, the first windward surface and the second windward surface are parallel to each other.

4. The multi-coil microchannel heat exchanger according to claim 3, wherein viewed along the length direction of the multi-coil microchannel heat exchanger, the first windward surface and the second windward surface are parallel to a height direction of the multi-coil microchannel heat exchanger.

5. The multi-coil microchannel heat exchanger according to claim 3, wherein viewed along the length direction of the multi-coil microchannel heat exchanger, the first windward surface and the second windward surface are inclined to a height direction of the multi-coil microchannel heat exchanger.

6. The multi-coil microchannel heat exchanger according to claim 1, wherein viewed along the length direction of the multi-coil microchannel heat exchanger, the first windward surface and the second windward surface cross each other.

7. The multi-coil microchannel heat exchanger according to claim 6, wherein the first coil comprises a first upper end and a first lower end along a height direction of the multi-coil microchannel heat exchanger, the second coil comprises a second upper end and a second lower end along the height direction of the multi-coil microchannel heat exchanger, the first upper end and the second upper end are aligned in a thickness direction of the multi-coil microchannel heat exchanger, and the first lower end and the second lower end are offset in the thickness direction of the multi-coil microchannel heat exchanger.

8. The multi-coil microchannel heat exchanger according to claim 6, wherein the first coil comprises a first upper end and a first lower end along a height direction of the multi-coil microchannel heat exchanger, the second coil comprises a second upper end and a second lower end along the height direction of the multi-coil microchannel heat exchanger, the first upper end and the second upper end are offset in a thickness direction of the multi-coil microchannel heat exchanger, and the first lower end and the second lower end are offset in the thickness direction of the multi-coil microchannel heat exchanger.

9. The multi-coil microchannel heat exchanger according to claim 1, wherein the first coil and the second coil are same.

10. The multi-coil microchannel heat exchanger according to claim 1, wherein the first inlet header, the first inlet connector, the second inlet header, the second inlet connector, the first outlet header, the first outlet connector, the second outlet header and the second outlet connector are all located at a bottom of the multi-coil microchannel heat exchanger.

11. The multi-coil microchannel heat exchanger according to claim 10, wherein the first inlet header and the first outlet header are located at the bottom of the first coil, the second inlet header and the second outlet header are located at the bottom of the second coil, and the first inlet header, the first outlet header, the second inlet connector and the second outlet connector are respectively arranged along the thickness direction of the multi-coil microchannel heat exchanger.

12. The multi-coil microchannel heat exchanger according to claim 1, wherein the first inlet header, the first inlet connector, the second inlet header and the second inlet connector are located at the bottom of the multi-coil microchannel heat exchanger, and the first outlet header, the first outlet connector, the second outlet header and the second outlet connector are located at a top of the multi-coil microchannel heat exchanger.

13. The multi-coil microchannel heat exchanger according to claim 12, wherein the first inlet header is located at the bottom of the first coil, the second inlet header is located at the bottom of the second coil, the second inlet connector is located at one side of the first inlet header along a thickness direction of the multi-coil microchannel heat exchanger, the first outlet header is located at the top of the first coil, the second outlet header is located at the top of the second coil, and the second outlet connector is located at another side of the first outlet header along the thickness direction of the multi-coil microchannel heat exchanger.

14. The multi-coil microchannel heat exchanger according to claim 1, wherein the multi-coil microchannel heat exchanger comprises at least one layer of coils, each layer of coils comprises at least two coils, the at least two coils are sequentially arranged along the length direction of the multi-coil microchannel heat exchanger, and the at least two coils comprise the first coil and the second coil.

15. The multi-coil microchannel heat exchanger according to claim 14, wherein the at least one layer of coils comprises a first layer of coils and a second layer of coils, the first layer of coils and the second layer of coils are arranged offset from each other in a height direction of the multi-coil microchannel heat exchanger.

16. The multi-coil microchannel heat exchanger according to claim 15, further comprising:

a deflector, wherein the deflector connects to an upper end of the first layer of coils and a lower end of the second layer of coils.

17. An air conditioning unit, comprising the multi-coil microchannel heat exchanger according to claim 1.

* * * * *